US007885808B2

(12) United States Patent
Goto

(10) Patent No.: US 7,885,808 B2
(45) Date of Patent: Feb. 8, 2011

(54) PITCH-ESTIMATION METHOD AND SYSTEM, AND PITCH-ESTIMATION PROGRAM

(75) Inventor: Masataka Goto, Tsukuba (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 739 days.

(21) Appl. No.: 11/910,308

(22) PCT Filed: Mar. 31, 2006

(86) PCT No.: PCT/JP2006/306899

§ 371 (c)(1),
(2), (4) Date: Nov. 30, 2007

(87) PCT Pub. No.: WO2006/106946

PCT Pub. Date: Oct. 12, 2006

(65) Prior Publication Data

US 2008/0312913 A1 Dec. 18, 2008

(30) Foreign Application Priority Data

Apr. 1, 2005 (JP) ..... 2005-106952

(51) Int. Cl.
*G10L 11/04* (2006.01)
*G10H 5/00* (2006.01)
*G10H 1/18* (2006.01)

(52) U.S. Cl. ..... 704/207; 84/654; 84/616

(58) Field of Classification Search ..... 704/207, 704/E11.006; 84/654, 616
See application file for complete search history.

(56) References Cited

U.S. PATENT DOCUMENTS 5,046,100 A 9/1991 Thomson
6,188,979 B1 * 2/2001 Ashley ..... 704/205
6,418,407 B1 * 7/2002 Huang et al. ..... 704/207
6,525,255 B1 2/2003 Funaki
2004/0158462 A1 * 8/2004 Rutledge et al. ..... 704/207

FOREIGN PATENT DOCUMENTS

JP 3-32073 5/1991

(Continued)

OTHER PUBLICATIONS

Kameoka et al. "Separation of Harmonic Structures Based on Tied Gaussian Mixture Model and Information Criterion for Concurrent Sounds," in International Conference on Acoustics, Speech, and Signal Processing, IEEE ICASSP, Montreal, Canada, 2004.*

(Continued)

*Primary Examiner*—James S Wozniak
*Assistant Examiner*—Edgar Guerra-Erazo
(74) *Attorney, Agent, or Firm*—Rankin, Hill & Clark LLP

(57) ABSTRACT

A pitch-estimation method, a pitch-estimation system, and a pitch-estimation program are provided, which estimate a weight of a probability density function of a fundamental frequency and relative amplitude of a harmonic component through fewer computations than ever. In the improved pitch-estimation method, 1200 $\log_2$ h and exp[−(x−(F+1200 $\log_2$ h))$^2$/2W$^2$] in the following expression are computed in advance and then stored in a memory of a computer:

$$c^{r(t)}(h \mid F, m)\frac{1}{\sqrt{2\pi W^2}}\exp\left(-\frac{(x-(F+1200\ \log_2 h))^2}{2W^2}\right) \tag{61}$$

The above expression is computed only with respect to a fundamental frequency F wherein x−(F+1200 $\log_2$ h) is close to zero. With this arrangement, computations to be performed may considerably be reduced, and computing time may accordingly be shortened.

15 Claims, 3 Drawing Sheets

FOREIGN PATENT DOCUMENTS

| | | |
|---|---|---|
| JP | 10-207455 | 8/1998 |
| JP | 2001-125562 | 5/2001 |
| JP | 2003-076393 | 3/2003 |
| WO | 88/07740 | 10/1988 |

OTHER PUBLICATIONS

Marolt, Matija. "Gaussian Mixture Models for Extraction of Melodic Lines from Audio Recordings". In Proc. Int. Conf. Music Information Retrieval, Barcelona, Spain, 2004, pp. 80-83.*

M. Marolt "On finding melodic lines in audio recordings", Proc. DAFX, pp. 217 2004.*

A Predominant-F0 Estimation Method For CD Recordings: Map Estimation Using EM Algorithm For Adaptive Tone Models, Masataka Goto, IEEE International on Acountics, Speech, and Signal Proceedings, May 2001, pp. 3365-3368.

A real-time music-scene-description system: predominant-F0 estimation for detecting melody and bass lines in real-world audio signals, Masataka Goto, Speech Communication 43 (2004) 311-329.

Martin Vetterli, "A Theory of Multirate Filter Banks", IEEE Transactions on Acoustics, Speech, and Signal Processing, vol. ASSP-35, No. 3, Mar. 1987, pp. 356-372.

Demster, A.P; Laird, N.M; Rubin, D.B; "Maximum Likelihood from Incomplete Data via the EM Aligorithm", Journal of the Royal Statistical Society, Series B (Methodological), vol. 39. No. 1 (1977) pp. 1-38.

* cited by examiner

PITCH-ESTIMATION METHOD AND SYSTEM, AND PITCH-ESTIMATION PROGRAM

TECHNICAL FIELD

The present invention relates to a pitch-estimation method, a pitch-estimation system, and a pitch-estimation program that estimates a pitch in terms of fundamental frequency and a volume of each component sound (having a fundamental frequency) of a sound mixture.

BACKGROUND ART

Real-world audio signals of CD recordings or the like are sound mixtures for which it is impossible to assume the number of sound sources in advance. In the sound mixtures as described above, frequency components frequently overlap with each other. In addition, there is also a sound having no fundamental frequency component. Most of conventional pitch-estimation technologies, however, assume a small number of sound sources, and locally trace frequency components, or depend on existence of fundamental frequency components. For this reason, these technologies cannot be applied to the real-world sound mixtures described above.

Then, the inventor of the present invention proposed an invention entitled "Method and Device for Estimating Pitch" as disclosed in Japanese Patent No. 3413634 (Patent Document 1). In this disclosure, it is considered that an input sound mixture simultaneously includes sounds of different fundamental frequencies (corresponding to "pitches" abstractly used in the specification of the present application) in various volumes. In this invention, in order to utilize a statistical approach, frequency components of the input are represented as a probability density function (an observed distribution), and a probability distribution corresponding to a harmonic structure of each sound is introduced as a tone model. Then, it is considered that the probability density function of the frequency components has been generated from a mixture distribution model (a weighted sum model) of tone models for all target fundamental frequencies. Since a weight of each tone model in the mixture distribution indicates how relatively dominant each harmonic structure is, the weight of each tone model is referred to as a probability density function of a fundamental frequency (the more dominant the tone model becomes in the mixture distribution, the higher probability of the fundamental frequency indicated by that model will become). The weight value (or the probability density function of the fundamental frequency) may be estimated by using the EM (Expectation-Maximization) algorithm (Dempster, A. P., Laird, N. M and Rubin, D. B.: Maximum likelihood from incomplete data via the EM algorithm, J. Roy, Stat. Soc. B, Vol. 39, No. 1, pp. 1-38 (1977)). The probability density function of the fundamental frequency thus obtained indicates at which pitch and in how much volume a component sound of the sound mixture sounds.

The inventor of the present invention has announced technologies, which have developed or enhanced the previous invention titled "Method and Device for Estimating Pitch," in two non-patent papers, Non-Patent Document 1 and Non-Patent Document 2. Non-Patent Document 1 is "A PREDOMINANT-FO ESTIMATION METHOD FOR CD RECORDINGS: MAP ESTIMATION USING EM ALGORITHM FOR ADAPTIVE TONE MODELS" that was announced in May 2001. This paper was released in the proceedings V of "The 2001 IEEE International Conference on Acoustics, Speech, and Signal Processing" pp. 3365-3368.

Non-patent Document 2 is "A real-time music-scene-description system: predominant-FO estimation for detecting melody and bass lines in real-world audio signals" that was announced in September 2004. This paper was released in "Speech Communication 43 (2004)", pp. 311-329. The enhancements proposed in these two Non-patent Documents are use of multiple tone models, tone model parameter estimation, and introduction of prior distribution for model parameters. These enhancements will be described later in detail.

DISCLOSURE OF THE INVENTION

Problem to be Solved by the Invention

In implementing the enhanced technologies described above using a computer, to thereby estimate a weight of the probability density function of a fundamental frequency and relative amplitude of a harmonic component, computations are inevitably performed for extremely many times. Thus, there is a problem that an estimation result cannot be obtained in a short time unless a computer capable of computing at high speed is employed.

An object of the present invention is therefore to provide a pitch-estimation method, a pitch-estimation system, and a pitch-estimation program capable of estimating a weight of a probability density function of a fundamental frequency and relative amplitude of a harmonic component through fewer computations than ever.

Means for Solving the Problem

In a pitch-estimation method of the present invention, a weight of a probability density function of a fundamental frequency and relative amplitude of a harmonic component are estimated as described below.

First, frequency components included in an input sound mixture are observed and the observed frequency components are represented as a probability density function given by the following expression (a) where x is the log-scale frequency and t is time:

$$p_{\Psi}^{(t)}(x) \tag{a}$$

Then, technologies disclosed in Non-patent Documents 1 and 2 (use of multiple tone models, tone model parameter estimation, and introduction of a prior distribution for model parameters) are adopted in a process of obtaining from the probability density function of the observed frequency components represented by the above expression (a) a probability density function of a fundamental frequency F represented by the following expression (b)

$$p_{F0}^{(t)}(F) \tag{b}$$

In the use of multiple tone models, assuming that M types of tone models are present for a fundamental frequency, a probability density function of an m-th tone model for the fundamental frequency F is represented by $p(x|F,m,\mu^{(t)}(F,m))$, where $\mu^{(t)}(F,m)$ represents a set of model parameters indicating relative amplitude of a harmonic component of the m-th tone model.

In the tone model parameter estimation, it is assumed that the probability density function of the observed frequency components has been generated from a mixture distribution model $p(x|\theta^{(t)})$ defined by the following expression (c):

$$p(x \mid \theta^{(t)}) = \int_{F1}^{Fh} \sum_{m=1}^{M} \omega^{(t)}(F, m) p(x \mid F, m, \mu^{(t)}(F, m)) dF \quad \text{(c)}$$

where $\omega^{(t)}(F,m)$ indicates a weight of the m-th tone model for the fundamental frequency F.

In the expression (c), $\theta^{(t)}$ denotes a set of model parameters $\theta^{(t)}=\{\omega^{(t)},\mu^{(t)}\}$ including the weight $\omega^{(t)}(F,m)$ of the tone model and the relative amplitude $\mu^{(t)}(F,m)$ of the harmonic components of the tone model, $\omega^{(t)}=\{\omega^{(t)}(F,m)|Fl \leqq F \leqq Fh, m=1, \ldots, M\}$, $\mu^{(t)}=\{\mu^{(t)}(F,m)|Fl \leqq F \leqq Fh, m=1, \ldots, M\}$ in which Fl denotes an allowable lower limit of the fundamental frequency and Fh denotes an allowable upper limit of the fundamental frequency.

Then, the probability density function of the fundamental frequency F represented by the expression (b) is obtained from the weight $\omega^{(t)}(F,m)$ based on the interpretation of the following expression (d):

$$p_{F0}^{(t)}(F) = \sum_{m=1}^{M} \omega^{(t)}(F, m) \quad (F1 \leq F \leq Fh) \quad \text{(d)}$$

In the introduction of a prior distribution for model parameters, a MAP (maximum a posteriori probability) estimator of the model parameter $\theta^{(t)}$ is performed based on a prior distribution of the model parameter $\theta^{(t)}$ by using the EM (Expectation-Maximization) algorithm. Then, expressions (e) and (f) for obtaining two parameter estimates are defined by this estimation, taking account of the prior distributions:

$$\overline{\omega^{(t)}(F, m)} = \frac{\overline{\omega_{ML}^{(t)}(F, m)} + \beta_{\omega i}^{(t)} \omega_{0i}^{(t)}(F, m)}{1 + \beta_{\omega i}^{(t)}} \quad \text{(e)}$$

$$\overline{c^{(t)}(h \mid F, m)} = \frac{\overline{\omega_{ML}^{(t)}(F, m)\, c_{ML}^{(t)}(h \mid F, m)} \beta_{\mu i}^{(t)}(F, m) c_{0i}^{(t)}(h \mid F, m)}{\overline{\omega_{ML}^{(t)}(F, m)} + \beta_{\mu i}^{(t)}(F, m)} \quad \text{(f)}$$

The expressions (e) and (f) are used for obtaining the weight $\omega^{(t)}(F,m)$ that can be interpreted as the probability density function of the fundamental frequency F represented by the expression (b) and the relative amplitude $c^{(t)}(h|F,m)$ (h=1, . . . , H) of an h-th harmonic component represented by the model parameter $\mu^{(t)}(F,m)$ of the probability density function $p(x|F,m,\mu^{(t)}(F,m))$ for all the tone models. H stands for the number of harmonic components including a frequency component of the fundamental frequency or how many harmonic components including a frequency component of the fundamental frequency are present. The following expressions (g) and (h) in the expressions (e) and (f) indicate maximum likelihood estimates in non-informative prior distributions when the following expressions (i) and (j) are equal to zero:

$$\overline{\omega_{ML}^{(t)}(F, m)} = \int_{-\infty}^{\infty} p_{\Psi}^{(t)}(x) \frac{\omega'^{(t)}(F, m) p(x \mid F, m, \mu'^{(t)}(F, m))}{\int_{Fl}^{Fh} \sum_{\nu=1}^{M} \omega'^{(t)}(\eta, \nu) p(x \mid \eta, \nu, \mu'^{(t)}(\eta, \nu)) d\eta} dx \quad \text{(g)}$$

-continued $$\overline{c_{ML}^{(t)}(h \mid F, m)} = \frac{1}{\overline{\omega_{ML}^{(t)}(F, m)}} \int_{-\infty}^{\infty} p_{\Psi}^{(t)}(x) \frac{\omega'^{(t)}(F, m) p(x, h \mid F, m, \mu'^{(t)}(F, m))}{\int_{Fl}^{Fh} \sum_{\nu=1}^{M} \omega'^{(t)}(\eta, \nu) p(x \mid \eta, \nu, \mu'^{(t)}(\eta, \nu)) d\eta} dx \quad \text{(h)}$$

$$\beta_{\omega i}^{(t)} \quad \text{(i)}$$

$$\beta_{\mu i}^{(t)}(F, m) \quad \text{(j)}$$

In the expressions (e) and (f), an expression (k) is a most probable parameter at which an unimodal prior distribution of the weight $\omega^{(t)}(F,m)$ takes its maximum value, and an expression (l) is a most probable parameter at which an unimodal prior distribution of the model parameter $\mu^{(t)}(F,m)$ takes its maximum value:

$$w_{0i}^{(t)}(F,m) \quad \text{(k)}$$

$$c_{0i}^{(t)}(h|F,m) \quad \text{(l)}$$

The expression (i) is a parameter that determines how much emphasis is put on the maximum value represented by the expression (k) in the prior distribution, and the expression (j) indicates a parameter that determines how much emphasis is put on the maximum value represented by the expression (l) in the prior distribution:

In the expressions (g) and (h), $\omega'^{(t)}(F,m)$ and $\mu'^{(t)}(F,m)$ are respectively immediately preceding old parameter estimates when the expressions (e) and (f) are iteratively computed, $\eta$ denotes a fundamental frequency, and $\nu$ indicates what number tone model in the order of all the tone models.

In the pitch-estimation method, improvement of which is aimed at by the present invention, through computations using a computer, the weight $\omega^{(t)}(F,m)$ that can be interpreted as the probability density function of the fundamental frequency of the expression (b) is obtained, and the relative amplitude $c^{(t)}$ (h F,m) of the h-th harmonic component as represented by the model parameter $\mu^{(t)}(F,m)$ of the probability density function $p(x|F,m,\mu^{(t)}(F,m))$ for all the tone models is obtained, by iteratively computing the expressions (e) and (f) for obtaining the two parameter estimates, to thereby estimate a pitch in terms of fundamental frequency. The fundamental frequency or the pitch is thus estimated.

In the present invention, the parameter estimate represented by the expression (e) and the parameter estimate represented by the expression (f) are computed by the computer using the estimates represented by the expressions (g) and (h) as described below. To do this, first, the numerator of the expression showing the estimate represented by the expression (g) is expanded as a function of x given by the following expression (m):

$$\omega'^{(t)}(F, m) \sum_{h=1}^{H} c'^{(t)}(h \mid F, m) \frac{1}{\sqrt{2\pi W^2}} \exp\left(-\frac{(x - (F + 1200 \log_2 h))^2}{2W^2}\right) \quad \text{(m)}$$

where $\omega'^{(t)}(F,m)$ denotes an old weight, $c'^{(t)}(h|F,m)$ denotes an old relative amplitude of the h-th harmonic component, E stands for the number of the harmonic components including the frequency component of the fundament frequency, m indicates what number tone model in the order of the M types of tone models, and W stands for a standard deviation of a Gaussian distribution for each of the harmonic components.

$1200 \log_2 h$ and $\exp[-(x-(F+1200 \log_2 h))^2/2W^2]$ in the expression (m) are computed in advance and then stored in a memory of the computer.

In order to iteratively compute the expressions (e) and (f) for obtaining the two parameter estimates for a predetermined number of times, after the frequency axis of the probability density function of the observed frequency components has been discretized or sampled, a first computation in computing the expressions (g) and (h) is performed for Nx times on each of frequencies x where Nx denotes a discretization number or the number of samples in a definition range for the frequency x.

In the first computation, a second computation described below is performed on each of the M types of tone models in order to obtain a result of computation of the expression (m). Then, the result of computation of the expression (m) is integrated or summed for the fundamental frequency F and the m-th tone model in order to obtain the denominator of each of the expressions (g) and (h), and the probability density function of the observed frequency components is assigned into the expressions (g) and (h) thereby computing the expressions (g) and (h).

In the second computation, a third computation described below is performed for H times corresponding to the number of the harmonic components including the frequency component of the fundamental frequency in order to obtain a result of computation of the following expression (n), and a result of the expression (m) is obtained by performing the summation of the results of the expression (n), changing the value of h from 1 to H:

$$\omega'^{(t)}(F, m)c'^{(t)}(h \mid F, m)\frac{1}{\sqrt{2\pi W^2}}\exp\left(-\frac{(x-(F+1200 \log_2 h))^2}{2W^2}\right) \quad \text{(n)}$$

In the third computation, a fourth computation described below is performed for Na times with respect to the fundamental frequency F wherein $x-(F+1200 \log_2 h)$ is close to zero, in order to obtain a result of computation of the above expression (n). Here, Na denotes a small positive integer indicating the number of the fundamental frequencies F obtained by discretizing or sampling in a range in which $x-(F+1200 \log_2 h)$ is sufficiently close to zero.

Then, in the fourth computation, a result of an expression (o) is obtained using $\exp[-(x-(F+1200 \log_2 h))^2/2W^2]$ stored in the memory in advance:

$$c'^{(t)}(h \mid F, m)\frac{1}{\sqrt{2\pi W^2}}\exp\left(-\frac{(x-(F+1200\log_2 h))^2}{2W^2}\right) \quad \text{(o)}$$

Finally, the expression (o) is multiplied by the old weight $\omega'^{(t)}(F,m)$ to obtain a result of computation of the expression (n).

According to the method of the present invention, $\exp[-(x-(F+1200 \log_2 h))^2/2W^2]$ stored in the memory in advance may be used. Thus, the number of times of computation can be reduced. In the present invention in particular, it has been found that even if the number of times of the fourth computation is reduced to Na times and the result of computation of the expression (m) is obtained, computing accuracy is not lowered. On the basis of this finding, the number of times of the fourth computation is limited. As a result, the number of times of computation may considerably be reduced more than ever, thereby shortening the computing time.

When a discretization width or sampling resolution of each of the log-scale frequency x and the fundamental frequency F is defined as d, a positive integer b that is smaller than or close to (3W/d) may be calculated, thereby determining Na to be (2b+1) times. When the discretization and computations are performed, $x-(F+1200 \log_2 h)$ takes (2b+1) possible values including $-b+\alpha, -b+1+\alpha, \ldots, 0+\alpha, \ldots, b-1+\alpha$, and $b+\alpha$. Then, it is preferable that values of $\exp[-(x-(F+1200 \log_2 h))^2/2W^2]$ when $x-(F+1200 \log_2 h)$ takes the (2b+1) possible values including $-b+\alpha, -b+1+\alpha, \ldots, 0+\alpha, \ldots, b-1+\alpha$, and $b+\alpha$ may be stored in the memory in advance. W described before denotes the standard deviation of the Gaussian distribution representing the harmonic components when each harmonic component is represented by the Gaussian distribution. Here, $\alpha$ denotes a decimal equal to or less than 0.5, and is determined according to how the discretized $(F+1200 \log_2 h)$ is represented. A value of three in the numerator of (3W/d) may be an arbitrary positive integer other than three, and the smaller the value is, the fewer the number of times of computation will be.

More specifically, it is preferable that when the discretization width of each of the log-scale frequency x and the fundamental frequency F is 20 cents (one fifth of a semitone pitch difference of 100 cents) and the standard deviation W is 17 cents, Na may be defined as five (5). When the discretization and computations are performed, $x-(F+1200 \log_2 h)$ takes five values of $-2+\alpha, -1+\alpha, 0+\alpha, 1+\alpha$, and $2+\alpha$. Here, $\alpha$ denotes a decimal equal to or less than 0.5, and is determined according to how the discretized $(F+1200 \log_2 h)$ is represented. With this arrangement, the number of times of computation may be greatly reduced. It is preferable that values of $\exp[-(x-(F+1200 \log_2 h))^2/2W^2]$, in which $x-(F+1200 \log_2 h)$ takes values of $-2+\alpha, -1+\alpha, \ldots, 0+\alpha, \ldots, 1+\alpha$, and $2+\alpha$, may be stored in advance. $1200 \log_2 h$ may also be computed and stored in advance. Consequently, the number of times of computation may be furthermore reduced.

In a pitch-estimation system of the present invention, the pitch-estimation method of the present invention described before is implemented using a computer. In order to achieve this purpose, the pitch-estimation system of the present invention comprises: means for expanding the numerator of the expression showing the estimate represented by the expression (g) as the function of x given by the expression (m); means for computing $1200 \log_2 h$ and $\exp[-(x-(F+1200 \log_2 h))^2/2W^2]$ in the expression (m) in advance and storing the results of the computation in a memory of the computer; first computation means for performing the first computation described before; second computation means for performing the second computation described before; third computation means for performing the third computation described before; and fourth computation means for performing the fourth computation described before.

A pitch-estimation program of the present invention is installed in a computer in order to implement the pitch-estimation method of the present invention using the computer. The pitch-estimation program of the present invention is so configured that a function of expanding the numerator of the expression showing the estimate represented by the expression (g) as the function of x given by the expression (m), a function of computing $1200 \log_2 h$ and $\exp[-(x-(F+1200 \log_2 h))^2/2W^2]$ in the expression (m) in advance and then storing the results of the computation in a memory of the computer, a function of performing the first computation described before, a function of performing the second computation described before, a function of performing the third computation described before, and a function of performing the fourth computation described before are implemented in the computer.

Effect of the Invention

According to the present invention, when pitch estimation is performed without assuming the number of sound sources, without locally tracing a frequency component, and without assuming existence of a fundamental frequency component, computations to be performed may considerably be reduced, and computing time may accordingly be shortened.

BEST MODE FOR CARRYING OUT THE INVENTION

Figure 1:
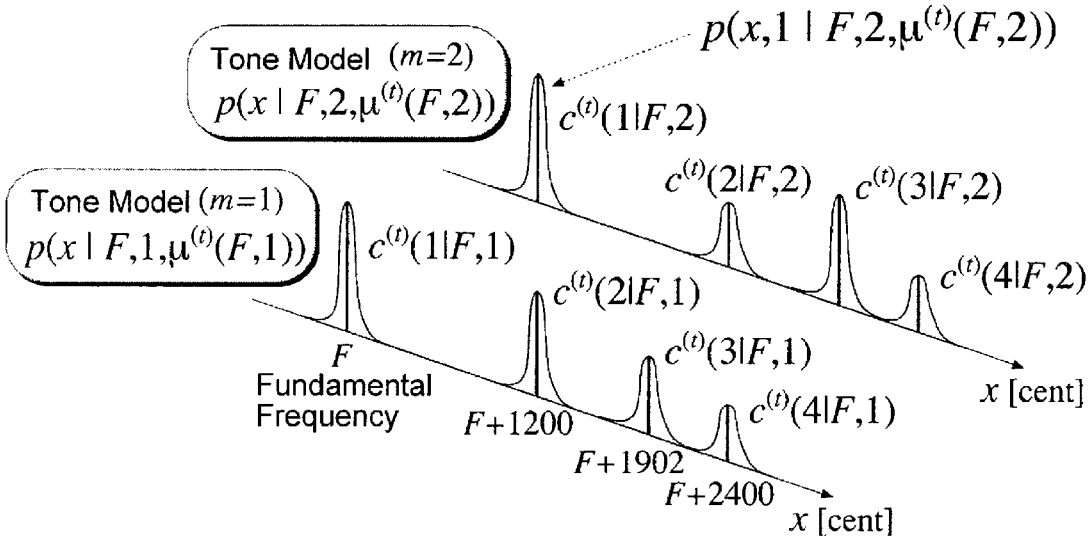
FIG. 1 is a diagram used for explaining tone model parameter estimation.

An embodiment of a pitch-estimation method and a pitch-estimation program of the present invention will be described below in detail with reference to drawings. First, as a premise for describing the embodiment of the method according to the present invention, three publicly known enhancements proposed in Non-patent Documents 1 and 2, which have enhanced the invention of Japanese Patent No. 3413634, will be briefly described below.

Enhancement 1

Use of Multiple Tone Models

In the invention described in Japanese Patent No. 3413634, only one tone model is provided for a fundamental frequency. In actuality, however, tones having different harmonic structures may appear one after another at a certain fundamental frequency. A plurality of tone models are therefore provided for a fundamental frequency, and those tone models are subjected to mixture distribution modeling. A specific method for using multiple tone models will be described later in details.

Enhancement 2

Tone Model Parameter Estimation

In the conventional tone model described in Patent No. 3413634, relative amplitude of each harmonic component is fixed (namely, a certain ideal tone model is assumed). However, this does not always match a harmonic structure in a real-world sound mixture. For increased accuracy, there remains some room for further improvement. Then, in the enhancement 2, the relative amplitude of the harmonic component of a tone model is also used as a model parameter, and tone model parameters at each time are estimated by the EM algorithm. A specific method of the estimation will be described later.

Enhancement 3

Introduction of Prior Distribution for Model Parameters

In a conventional method described in Patent No. 3413634, prior knowledge about a weight of the tone model (a probability density function of a fundamental frequency) is not assumed. However, when the present invention is employed in various applications, priority may be given to obtaining the fundamental frequency that is less subject to erroneous detection, by giving prior knowledge that the fundamental frequency is present in the vicinity of a certain frequency. For the purpose of music performance analysis, vibrato analysis, or the like, for example, it is demanded that, by singing or playing a musical instrument while listening to a musical composition through headphones, an appropriate fundamental frequency at each time should be given as the prior knowledge, and a more accurate fundamental frequency in the real musical composition should be thereby obtained. Then, a conventional framework of model parameter maximum likelihood estimation is enhanced, and maximum a posteriori probability estimation (MAP Estimation: Maximum A Posteriori Probability Estimation) is performed, based on a prior distribution for model parameters. At that time, the prior distribution of the relative amplitudes of the harmonic components of the tone model, which has been added as the model parameter in the "Enhancement 2", is also introduced. A specific method of the introduction will be described later.

Now, the Enhancements 1 to 3 will be more specifically described, using expressions. First, a probability density function of observed frequency components included in an input sound mixture (input audio signals) is represented by the following expression (1):

$$p_{\Psi}^{(t)}(x) \tag{1}$$

Then, in a process of obtaining from the probability density function of the frequency components given by the above expression (1) a probability density function of a fundamental frequency F represented by the following expression (2), the enhancements are implemented as hereinafter described:

$$p_{F0}^{(t)}(F) \tag{2}$$

The probability density function of the observed frequency components as represented by the above expression (1) may be obtained from a sound mixture (input audio signals) using a multirate filter bank, for example (refer to Vetterli, M.: A Theory of Multirate Filter Banks, IEEE trans. on ASSP, Vol. ASSP-35, No. 3, pp. 356-372 (1987)). With regard to this multirate filter bank, an example of a structure and details of the filter bank in a binary tree form are described in FIG. 2 of Japanese Patent No. 3413634 and FIG. 3 of Non-patent Document 2 described before. In the expressions (1) and (2), t denotes time in units of a frame shift (10 msecs), and x and F respectively stand for a log-scale frequency and the fundamental frequency, both of which are expressed in cents Incidentally, a frequency $f_H$ expressed in Hz is converted to a frequency $f_{cent}$ expressed in cents using the following expression (3):

$$f_{cent} = 1200 \log_2 \frac{f_{Hz}}{440 \times 2^{\frac{3}{12}-5}} \tag{3}$$

Then, in order to implement the [Enhancement 1] and [Enhancement 2] described before, it is assumed that there are M types of tone models for a fundamental frequency, and a model parameter $\mu^{(t)}(F,m)$ is introduced into a probability density function $p(x|F,m,\mu^{(t)}(F,m))$ of the m-th tone model for the fundamental frequency F.

The following expressions (4) to (51), which will be described below, have already been disclosed in Non-patent Document 1 described before, as expressions (2) to (36). Reference should be therefore made to Non-patent Document 1.

The probability density function $p(x|F,m,\mu(t)(F,m))$ of the m-th tone model for the fundamental frequency F is represented as follows:

$$p(x \mid F, m, \mu^{(t)}(F, m)) = \sum_{h=1}^{H} p(x, h \mid F, m, \mu^{(t)}(F, m)) \tag{4}$$

$$p(x, h \mid F, m, \mu^{(t)}(F, m)) = c^{(t)}(h \mid F, m)G(x; F + 1200\log_2 h, W) \tag{5}$$

$$\mu^{(t)}(F, m) = \{c^{(t)}(h \mid F, m) \mid h = 1, \ldots, H\} \tag{6}$$

$$G(x; x_0, \sigma) = \frac{1}{\sqrt{2\pi\sigma^2}}\exp\left(-\frac{(x - x_0)^2}{2\sigma^2}\right) \tag{7}$$

The above expressions (4) to (7) indicate which harmonic component appears at which frequency in how much relative amplitude when the fundamental frequency is F (as shown in FIG. 1). In the above expressions, H stands for the number of harmonic components including a frequency component of the fundamental frequency F, and W for the standard deviation of a Gaussian distribution $G(x;X_0,\sigma)$. $c^{(t)}(h|F, m)$ determines the relative amplitude of the h-th harmonic component, which satisfies the following expression:

$$\sum_{h=1}^{H} c^{(t)}(h \mid F, m) = 1 \tag{8}$$

Then, it is assumed that the probability density function of the observed frequency components represented by the expression (1) has been generated from a mixture distribution model $p(x|\theta^{(t)})$ for the probability density function $p(x|F,m, \mu^{(t)}(F,m))$ as defined by the following expression:

$$p(x \mid \theta^{(t)}) = \int_{Fl}^{Fh} \sum_{m=1}^{M} w^{(t)}(F, m)p(x \mid F, m, \mu^{(t)}(F, m))\,dF \tag{9}$$

where $$\theta^{(t)} = \{w^{(t)}, \mu^{(t)}\} \tag{10}$$

$$w^{(t)} = \{w^{(t)}(F, m) \mid Fl \le F \le Fh, m = 1, \ldots, M\} \tag{11}$$

and $$\mu^{(t)} = \{\mu^{(t)}(F, m) \mid Fl \le F \le Fh, m = 1, \ldots, M\} \tag{12}$$

In the above expressions (11) and (12), Fh and Fl respectively denotes an allowable upper limit and an allowable lower limit of the fundamental frequency, and $w^{(t)}(F, m)$ denotes the weight of a tone model that satisfies the following expression:

$$\int_{Fl}^{Fh} \sum_{m=1}^{M} w^{(t)}(F, m)\,dF = 1 \tag{13}$$

Since it is impossible to assume in advance the number of sound sources for a sound mixture, it becomes important to simultaneously take into consideration all fundamental frequency possibilities for modeling as shown in the above expression (9). Then, when a model parameter $\theta^{(t)}$ can be finally estimated such that the observed probability density function represented by the expression (1) is likely to have been generated from the model $p(x|\theta^{(t)})$, the weight $w^{(t)}(F,m)$ of the model parameter $\theta^{(t)}$ indicates how relatively dominant each harmonic structure is. For this reason, the probability density function of the fundamental frequency F may be interpreted as follows:

$$p_{F0}^{(t)}(F) = \sum_{m=1}^{M} w^{(t)}(F, m) \quad (Fl \le F \le Fh) \tag{14}$$

Next, the introduction of the prior distribution of [Enhancement 3] described before will be performed. In order to implement [Enhancement 3], a prior distribution $p_{0i}(\theta^{(t)})$ of the model parameter $\theta^{(t)}$ is given by a product of expressions (20) and (21) in the following expression (19) as shown below. $p_{oi}(\omega^{(t)})$ and $p_{oi}(\mu^{(t)})$ represent unimodal prior distributions that respectively take their maximum values at respective corresponding most probable parameters defined as follows:

$$w_{0i}^{(t)}(F,m) \tag{15}$$

$$\mu_{0i}^{(t)}(F,m) \tag{16}$$

provided that the expression (16) is equal to expression (17):

$$c_{0i}^{(t)}(h \mid F, m) \tag{17}$$

$$\beta_{wi}^{(t)}, \beta_{\mu i}^{(t)}(F, m) \tag{18}$$

$$p_{0i}(\theta^{(t)}) = p_{0i}(w^{(t)})p_{0i}(\mu^{(t)}) \tag{19}$$

$$p_{0i}(w^{(t)}) = \frac{1}{Z_w}\exp(-\beta_{wi}^{(t)}D_w(w_{0i}^{(t)}; w^{(t)})) \tag{20}$$

$$p_{0i}(\mu^{(t)}) = \frac{1}{Z_\mu}\exp\left(-\int_{Fl}^{Fh}\sum_{m=1}^{M}\beta_{\mu i}^{(t)}(F, m)D_\mu(\mu_{0i}^{(t)}(F, m); \mu^{(t)}(F, m))\,dF\right) \tag{21}$$

where $Z_\omega$ and $Z_\mu$ are normalization factors, and parameters represented by an expression (18) determine how much importance should be put on the maximum values in the prior distributions, and the prior distributions become non-informative prior (uniform) distributions when these parameters are equal to zero (0). An expression (22) in the expression (20), and an expression (23) in the expression (21) are Kullback-Leibler's information (K-L Information) represented by expressions (24) and (25):

$$D_w(w_{0i}^{(t)}; w^{(t)}) \tag{22}$$

$$D_\mu(\mu_{0i}^{(t)}(F, m); \mu^{(t)}(F, m)) \tag{23}$$

$$D_w(w_{0i}^{(t)}; w^{(t)}) = \int_{Fl}^{Fh}\sum_{m=1}^{M} w_{0i}^{(t)}(F, m)\log\frac{w_{0i}^{(t)}(F, m)}{w^{(t)}(F, m)}\,dF \tag{24}$$

-continued $$D_\mu(\mu_{0i}^{(t)}(F, m); \mu^{(t)}(F, m)) = \sum_{h=1}^{H} c_{0i}^{(t)}(h \mid F, m)\log\frac{c_{0i}^{(t)}(h \mid F, m)}{c^{(t)}(h \mid F, m)} \tag{25}$$

It follows from the foregoing that when the probability density function represented by the expression (1) is observed, a problem to be solved is to estimate the parameter $\theta^{(t)}$ of the model $p(x|\theta^{(t)})$, taking account of the prior distribution $p_{oi}(\theta^{(t)})$. The maximum a posteriori probability estimator (MAP estimator) of the parameter $\theta^{(t)}$ based on the prior distribution $p_{oi}(\theta^{(t)})$ may be obtained by maximizing the following expression:

$$\int_{-\infty}^{\infty} p_\Psi^{(t)}(x)(\log p(x \mid \theta^{(t)}) + \log p_{0i}(\theta^{(t)}))\,dx \tag{26}$$

However, this maximization problem is too difficult to solve analytically. Thus, the EM algorithm (Dempster, A. P., Laird, N. M and Rubin, D. B.: Maximum likelihood from incomplete data via the EM algorithm, J. Roy. Stat. Soc. B, Vol. 39, No. 1, pp. 1-38 (1977)) is used for estimating the parameter $\theta^{(t)}$. The EM algorithm is often used to perform maximum likelihood estimation using incomplete observed data, and the EM algorithm can be applied to maximum a posteriori probability estimation as well. In the maximum likelihood estimation, an E-step (Expectation step) to obtain a conditional expectation of a mean log-likelihood and an M-step (Maximization step) to maximize the conditional expectation of the mean log-likelihood are alternately repeated. In the maximum a posteriori probability estimation, however, maximization of the sum of the conditional expectation and a log prior distribution is repeated. Herein, in each repetition, an old parameter estimate $\theta'(t)=\{w'(t), \mu'(t)\}$ is updated to obtain a new parameter estimate represented by the following expression (27):

$$\overline{\theta^{(t)}}=\{\overline{w^{(t)}},\overline{\mu^{(t)}}\} \tag{27}$$

Hidden variables F, m, and h are introduced, which respectively indicate from which harmonic overtone of which tone model for which fundamental frequency each frequency component observed at the log-scale frequency x has been generated, and the EM algorithm may be formulated as described below.

(E-Step)

In the maximum likelihood estimation, a conditional expectation $Q(\theta^{(t)}|\theta'^{(t)})$ of the mean log-likelihood is computed. In the maximum a posteriori probability estimation, $Q_{MAP}(\theta^{(t)}|\theta'^{(t)})$ is obtained by adding $\log p_{oi}(\theta^{(t)})$ to the conditional expectation $Q(\theta^{(t)}|\theta'^{(t)})$ of the mean log-likelihood.

$$Q_{MAP}(\theta^{(t)} \mid \theta'^{(t)}) = Q(\theta^{(t)} \mid \theta'^{(t)}) + \log p_{0i}(\theta^{(t)}) \tag{28}$$

$$Q(\theta^{(t)} \mid \theta'^{(t)}) = \int_{-\infty}^{\infty} p_\Psi^{(t)}(x)E_{F,m,h}[\log p(x, F, m, h|\theta^{(t)})|x, \theta'^{(t)}]\,dx \tag{29}$$

In the above expression, a conditional expectation $E_{F,m,h}[a|b]$ denotes an expectation a with respect to the hidden variables F, m, and h having a probability distribution determined by a condition b.

(M-Step)

$Q_{MAP}(\theta^{(t)}|\theta'^{(t)}$ is maximized as a function of $\theta^{(t)}$ to obtain a new updated estimate of an expression (30) using an expression (31):

$$\overline{\theta^{(t)}} \tag{30}$$

$$\overline{\theta^{(t)}} = \underset{\theta^{(t)}}{\operatorname{argmax}} Q_{MAP}(\theta^{(t)} \mid \theta'^{(t)}) \tag{31}$$

In the E-step, the expression (29) is expressed as follows:

$$Q(\theta^{(t)} \mid \theta'^{(t)}) = \int_{-\infty}^{\infty}\int_{Fl}^{Fh}\sum_{m=1}^{M}\sum_{h=1}^{H} p_\Psi^{(t)}(x) p(F, m, h \mid x, \theta'^{(t)})\log p(x, F, m, h \mid \theta^{(t)})\,dF\,dx \tag{32}$$

where a complete-data log-likelihood is given by the following expression:

$$\log p(x,F,m,h|\theta^{(t)})=\log(w^{(t)}(F,m)p(x,h|F,m,\mu^{(t)}(F,m))) \tag{33}$$

$\log p_{oi}(\theta^{(t)})$ is given by:

$$\log p_{0i}(\theta^{(t)}) = -\log Z_w Z_\mu - \int_{Fl}^{Fh}\sum_{m=1}^{M}\left(\beta_{wi}^{(t)} w_{0i}^{(t)}(F, m)\log\frac{w_{0i}^{(t)}(F, m)}{w^{(t)}(F, m)} + \beta_{\mu i}^{(t)}(F, m)\sum_{h=1}^{H} c_{0i}^{(t)}(h \mid F, m)\log\frac{c_{0i}^{(t)}(h \mid F, m)}{c^{(t)}(h \mid F, m)}\right)dF \tag{34}$$

Next, regarding the M-step, the expression (31) is a conditional problem of variation, where conditions are given by the expressions (8) and (13). This problem can be solved by introducing Lagrange multipliers $\lambda_\omega$ and $\lambda_\mu$ and using the following Euler-Lagrange differential equations:

$$\frac{\partial}{\partial w^{(t)}}\left(\int_{-\infty}^{\infty}\sum_{h=1}^{H} p_\Psi^{(t)}(x)p(F, m, h \mid x, \theta'^{(t)})(\log w^{(t)}(F, m) + \log p(x, h \mid F, m, \mu^{(t)}(F, m)))\,dx - \beta_{wi}^{(t)} w_{0i}^{(t)}(F, m)\log\frac{w_{0i}^{(t)}(F, m)}{w^{(t)}(F, m)} - \lambda_w\left(w^{(t)}(F, m) - \frac{1}{M(Fh - Fl)}\right)\right) = 0 \tag{35}$$

$$\frac{\partial}{\partial c^{(t)}}\left(\int_{-\infty}^{\infty} p_\Psi^{(t)}(x)p(F, m, h \mid x, \theta'^{(t)})\left(\log w^{(t)}(F, m) + \log c^{(t)}(h \mid F, m) + \log G(x; F + 1200\log_2 h, W))\,dx - \beta_{\mu i}^{(t)}(F, m)c_{0i}^{(t)}(h \mid F, m)\log\frac{c_{0i}^{(t)}(h \mid F, m)}{c^{(t)}(h \mid F, m)} - \lambda_\mu\left(c^{(t)}(h \mid F, m) - \frac{1}{H}\right)\right) = 0 \tag{36}$$

From these equations, the following expressions are obtained:

$$w^{(t)}(F, m) = \frac{1}{\lambda_w}\left(\int_{-\infty}^{\infty} p_{\Psi}^{(t)}(x)p(F, m \mid x, \theta'^{(t)})\,dx + \beta_{wi}^{(t)} w_{0i}^{(t)}(F, m)\right) \tag{37}$$

$$c^{(t)}(h \mid F, m) = \frac{1}{\lambda_\mu}\left(\int_{-\infty}^{\infty} p_{\Psi}^{(t)}(x)p(F, m, h \mid x, \theta'^{(t)})\,dx + \beta_{\mu i}^{(t)}(F, m)c_{0i}^{(t)}(h \mid F, m)\right) \tag{38}$$

In these expressions, the Lagrange multipliers are determined from the expressions (8) and (13) as follows:

$$\lambda_w = 1 + \beta_{wi}^{(t)} \tag{39}$$

$$\lambda_\mu = \int_{-\infty}^{\infty} p_{\Psi}^{(t)}(x)p(F, m \mid x, \theta'^{(t)})\,dx + \beta_{\mu i}^{(t)}(F, m) \tag{40}$$

According to Bayes' theorem, $p(F,m, h|x,\theta'^{(t)})$ and $p(F,m|x, \theta'^{(t)})$ are given by:

$$p(F, m, h \mid x, \theta'^{(t)}) = \frac{w'^{(t)}(F, m)p(x, h \mid F, m, \mu'^{(t)}(F, m))}{p(x \mid \theta'^{(t)})} \tag{41}$$

$$p(F, m \mid x, \theta'^{(t)}) = \frac{w'^{(t)}(F, m)p(x \mid F, m, \mu'^{(t)}(F, m))}{p(x \mid \theta'^{(t)})} \tag{42}$$

Finally, new parameter estimates of expressions (43) and (44) are obtained as follows:

$$\overline{w^{(t)}(F, m)} \tag{43}$$

$$\overline{c^{(t)}(h \mid F, m)} \tag{44}$$

$$\overline{w^{(t)}(F, m)} = \frac{\overline{w_{ML}^{(t)}(F, m)} + \beta_{wi}^{(t)} w_{0i}^{(t)}(F, m)}{1 + \beta_{wi}^{(t)}} \tag{45}$$

-continued $$\overline{c^{(t)}(h \mid F, m)} = \frac{\overline{w_{ML}^{(t)}(F, m)}\ \overline{c_{ML}^{(t)}(h \mid F, m)} + \beta_{\mu i}^{(t)}(F, m)c_{0i}^{(t)}(h \mid F, m)}{\overline{w_{ML}^{(t)}(F, m)} + \beta_{\mu i}^{(t)}(F, m)} \tag{46}$$

$$\overline{w_{ML}^{(t)}(F, m)} \tag{47}$$

$$\overline{c_{ML}^{(t)}(h \mid F, m)} \tag{48}$$

$$\beta_{wi}^{(t)} = 0\ \beta_{\mu i}^{(t)}(F, m) = 0 \tag{49}$$

$$\overline{w_{ML}^{(t)}(F, m)} = \int_{-\infty}^{\infty} p_{\Psi}^{(t)}(x) \frac{w'^{(t)}(F, m)p(x \mid F, m, \mu'^{(t)}(F, m))}{\int_{F1}^{Fh} \sum_{v=1}^{M} w'^{(t)}(\eta, v)p(x \mid \eta, v, \mu'^{(t)}(\eta, v))\,d\eta}\,dx \tag{50}$$

$$\overline{c_{ML}^{(t)}(h \mid F, m)} = \frac{1}{\overline{w_{ML}^{(t)}(F, m)}} \int_{-\infty}^{\infty} p_{\Psi}^{(t)}(x) \frac{w'^{(t)}(F, m)p(x, h \mid F, m, \mu'^{(t)}(F, m))}{\int_{F1}^{Fh} \sum_{v=1}^{M} w'^{(t)}(\eta, v)p(x \mid \eta, v, \mu'^{(t)}(\eta, v))\,d\eta}\,dx \tag{51}$$

where expressions of (47) and (48) are maximum likelihood estimates respectively obtained from expressions (50) and (51) in a non-informative prior distribution when an expression (49) is given.

By iteratively computing these expressions, the probability density function of the fundamental frequency represented by the expression (2) is obtained from the weight $w^{(t)}(F,m)$ using the expression (14), taking account of the prior distributions. Further, the relative amplitude $c^{(t)}(h|F,m)$ of each harmonic component of the probability density function $p(x|F, m, \mu^{(t)}(F, m))$ for all the tone models is also obtained. Thus, the [Enhancement 1] to [Enhancement 3] are implemented In order to execute the pitch estimation approach enhanced as described above in a computer, it is necessary to compute iteratively the expressions (45) and (46). In iteratively computing these expressions, however, computation workload of the expressions (50) and (51) is large. Accordingly, there arises a problem that when these expressions are computed in a computer with limited computing capability (at a slow computing speed), computations take a considerably long time.

The reason for the considerably long computing time will be described. Initially, the following paragraphs will describe what kind of computation is necessary when the expression (50) is computed in a usual manner in order to obtain a result. First, when the expression (50) is computed, a numerator in an integrand on a right side of the expression (50) is computed as a function of the log-scale frequency x with respect to the fundamental frequency F and m in a target range (or the numerator is expanded using the expressions (4) to (7)):

$$\begin{aligned} w'^{(t)}(F, m)p(x \mid F, m, \mu'^{(t)}(F, m)) &= w'^{(t)}(F, m)\sum_{h=1}^{H} p(x, h \mid F, m, \mu'^{(t)}(F, m)) = \\ &w'^{(t)}(F, m)\sum_{h=1}^{H} c'^{(t)}(h \mid F, m)G(x; F + 1200\log_2 h, W) = \\ &w'^{(t)}(F, m)\sum_{h=1}^{H} c'^{(t)}(h \mid F, m)\frac{1}{\sqrt{2\pi W^2}}\exp\left(-\frac{(x - (F + 1200\log_2 h))^2}{2W^2}\right) \end{aligned} \tag{52}$$

Herein, by way of example, it is assumed that the log-scale frequency x in a definition range is discretized into 360 ($N_x$) and that the fundamental frequency F in a range from Fl to Fh is discretized into 300 ($N_F$), for computation. The number M of the tone models is set to three, and the number H of the harmonic components is set to 16. In these settings, the following expression (53) is repeated 16 times in order to compute the expression (52):

$$c'^{(t)}(h \mid F, m)\frac{1}{\sqrt{2\pi W^2}}\exp\left(-\frac{(x-(F+1200\log_2 h))^2}{2W^2}\right) \tag{53}$$

In order to obtain the numerator in the integrand on the right side of the expression (50), the expression (52) is computed once with respect to a certain log-scale frequency x. Then, in order to obtain the denominator in the integrand on the right side of the expression (50), the expression (52) needs to be repeatedly computed 300×3 times ($N_F$×M times) with respect to the fundamental frequency F and m.

Further, since the log-scale frequency x takes 360 possible values within the definition range of the log-scale frequency x for integral computation or integration, the computation of the expression (53) needs to be repeated 16×(300×3)×360 times for the denominator, and 16×360 times for the numerator in order to obtain the following expression:

$$\overline{w_{ML}^{(t)}(F,m)} \tag{54}$$

Since the denominator is common even if the fundamental frequency F and m are changed, the denominator does not need to be computed more than once. The numerator, however, needs to be computed for all possible values (300) of the fundamental frequency F and all possible values (three) of m. For this reason, the expression (53) will be repeatedly computed 16×(300×3)×360 times ($H \times N_F \times M \times N_X$ times, or 5184000 times in total), for both the denominator and the numerator. When the numerator is computed earlier than the denominator, the denominator may be obtained by totalizing the numerators obtained by the repeated computations. Accordingly, even when the denominator and the numerator are both computed, computation of the expression (53) will be repeated 5184000 times.

Then, the present invention greatly reduces the computing time as described below, thereby facilitating the overall computation. A high-speed computing method of the present invention that has sped up the usual computing method described above will be described with reference to flowcharts of FIGS. 2 and 3, which illustrate an algorithm of the program of the present invention. First, in the computation of the expression (50), the numerator in the integrand on the right side of the expression (50) is computed as the function of the log-scale frequency x with respect to the fundamental frequency F and m within the target range, by using the expression (52).

Figure 2:
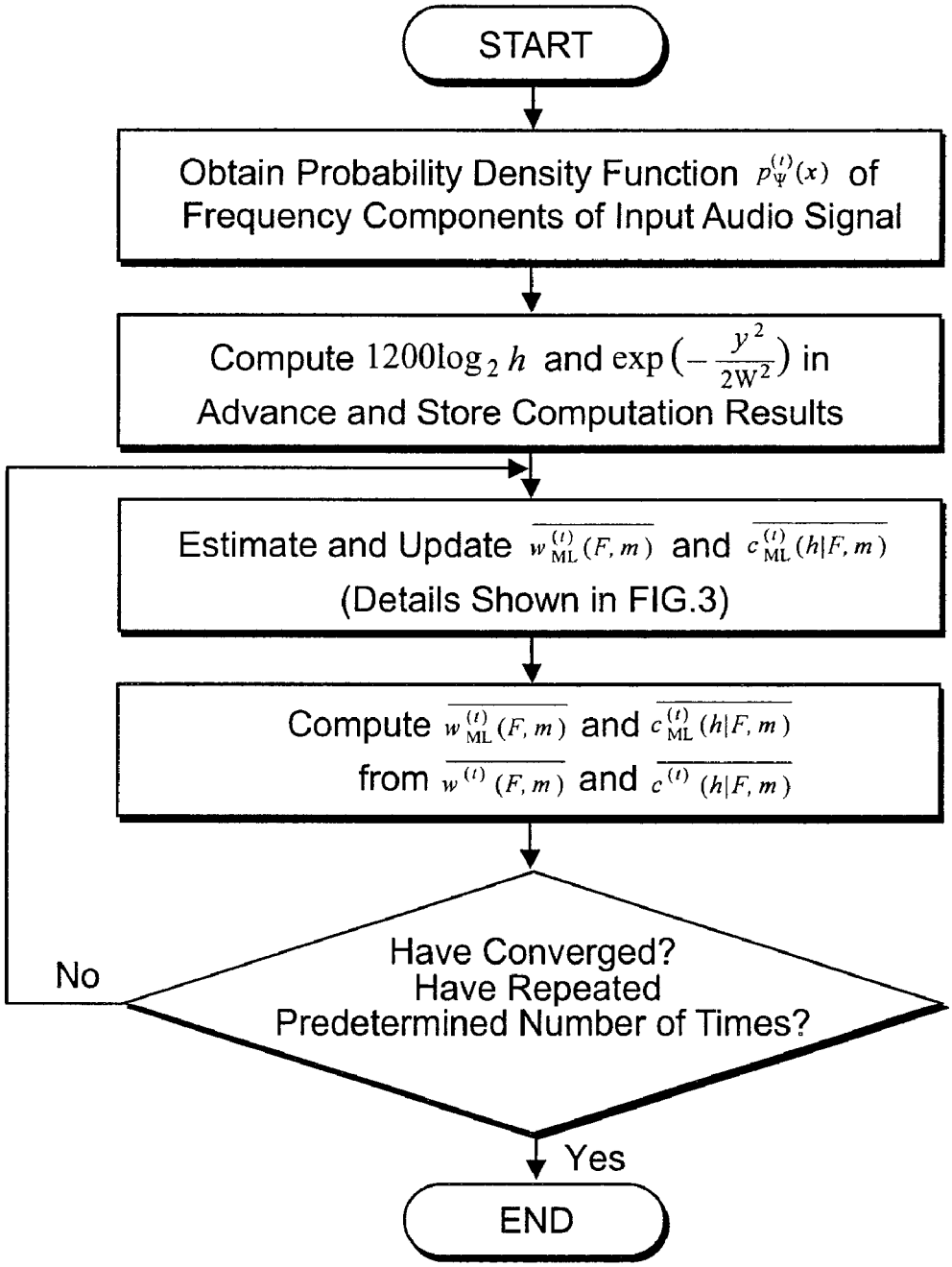
FIG. 2 is a flowchart showing an algorithm of a program of the present invention.
Figure 3:
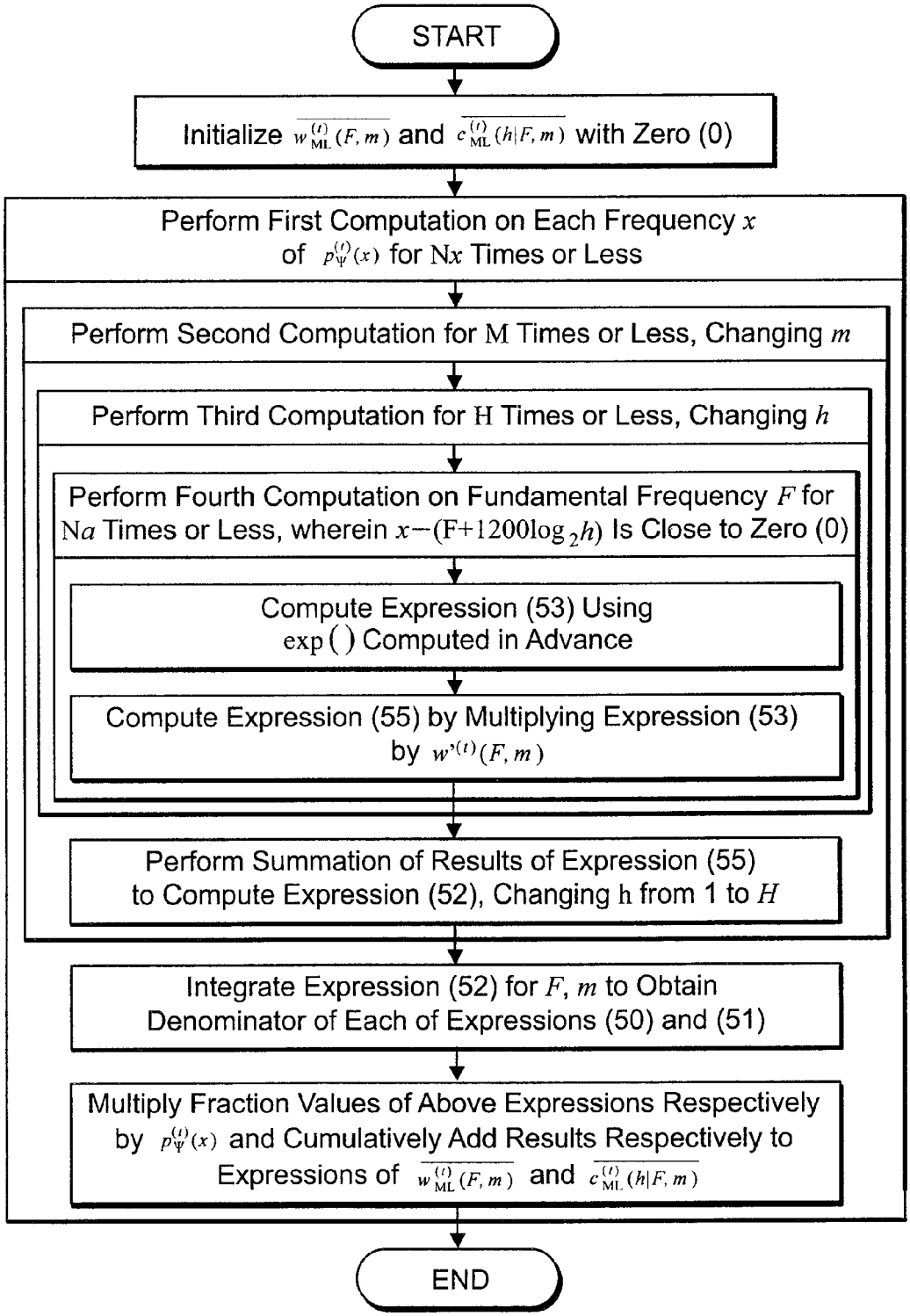
FIG. 3 is a flowchart showing a part of the algorithm in FIG. 2 in detail.

As shown in FIG. 2, 1200 $\log_2$ h and exp[−(x−(F+1200 $\log_2$ h))$^2$/2W$^2$] in the expression (52) are computed in advance and stored in a memory of the computer. Then, as shown in FIG. 3, in computation of the expressions (50) and (51), the expressions (47) and (48) are initialized with zero, and then the first computation described below is performed for $N_X$ times on each log-scale frequency x of the probability density function of the observed frequency components, in order to iteratively compute the expressions for obtaining the two parameter estimates represented by the expressions (45) and (46) for a predetermined number of times (or until convergence is obtained). Here, Nx indicates the discretization number the number of samples in the definition range of the log-scale frequency x.

In the first computation, the second computation described below is performed on each of the M types of tone models, thereby obtaining a result of computation of the expression (52). Then, the result of computation of the expression (52) is integrated or summed for the fundamental frequency F and the m-th tone model in order to obtain the denominator in the expressions (50) and (51). Then, the probability density function of the observed frequency components is assigned into the expressions (50) and (51) and the expressions (50) and (51) is thus computed.

In the second computation, the third computation described below is performed for a certain number of times corresponding to the number H of the harmonic components including the frequency component of the fundamental frequency in order to obtain a result of computation of the following expression (55).

$$\begin{aligned} &w'^{(t)}(F,m)p(x,h \mid F,m,\mu'^{(t)}(F,m)) = \\ &\quad w'^{(t)}(F,m)c'^{(t)}(h \mid F,m)G(x;F+1200\log_2 h,W) = \\ &\quad w'^{(t)}(F,m)c'^{(t)}(h \mid F,m)\frac{1}{\sqrt{2\pi W^2}}\exp\left(-\frac{(x-(F+1200\log_2 h))^2}{2W^2}\right) \end{aligned} \tag{55}$$

Then, the summation of the results of the expression (55) is performed, changing the value of h from 1 t H, thereby obtaining the result of computation of the expression (52).

In the expression (55), a numerator in the integrand on the right side of the expression (51) is computed as a function of the log-scale frequency x with respect to the fundamental frequency F, m, and h within the target range. The expression (55) is obtained by removing from the expression (52) the following expression:

$$\sum_{h=1}^{H} \tag{56}$$

In the third computation described above, the fourth computation described below is performed for Na times with respect to the fundamental frequency F wherein x−(F+1200 $\log_2$ h) is close to zero, thereby obtaining the result of computation of the expression (55). In the present invention, Na is defined as a small positive integer indicating the number of the fundamental frequencies F in a range where x−(F+1200 $\log_2$ h) is sufficiently close to zero. As will be described later, it is preferable that this integer, Na is set to five when the discretization width or sampling resolution d for each of the log-scale frequency x and the fundamental frequency E is 20 cents (which is one fifth of a semitone pitch difference of 100 cents) and the standard deviation W of the Gaussian distribution described before is 17 cents.

In the fourth computation, exp[−(x−(F+1200 $\log_2$ h))$^2$/2W$^2$] stored in the memory in advance is used in computation of the expression (53). Then, by multiplying the expression (53) by the old weight $w'^{(t)}$(F,m), the result of computation of the expression (55) is obtained. Thus, a pitch or fundamental frequency is estimated according to the present invention.

The foregoing process will more specifically be described by way of example.

When a difference between the log-scale frequency x and (F+1200 $\log_2$ h) becomes large, the following expression (57) rapidly approaches zero:

$$\exp\left(-\frac{(x-(F+1200\log_2 h))^2}{2W^2}\right) \tag{57}$$

Therefore, computation of the expression (57) in the expression (52) can be performed only when the difference is within a certain range. When the discretization width of each of the log-scale frequency x and the fundamental frequency F is 20 cents and the standard deviation W is 17 cents, for example, computation of the expression (57) is performed for 5 (Na) times within a range of ±2 times the discretization width, namely, when the discretization width is −40 cents, −20 cents, 0 cent, 20 cents, and 40 cents. Note that 20 cents are one fifth of the semitone pitch difference of 100 cents.

Now, the denominator in the integrand on the right side of the expression (50) is computed with respect to a certain log-scale frequency x. Due to the limit of a computation range described above, the expression (57) is computed only with respect to the log-scale frequency x in the vicinity of (F+1200 $\log_2$ h). Then, with respect to other log-scale frequencies x, the expression (57) is regarded as zero, and no computation is performed. With this arrangement, when the computation is performed starting from the certain log-scale frequency x, it is not necessary to repeat computation of the expression (53) 16×300×3 times, in order to obtain the denominator in the integrand on the right side of the expression (50). It is enough to repeat the computation 16×5×3 times (H×Na×M times). More specifically, an integration for a fundamental frequency η of the denominator in the integrand on the right side of the expression (50) can be computed just by computing an integration of the expression (53) relating to 16×5 values of the fundamental frequency η, namely, η values when the fundamental frequency η is substantially equal to the log-scale frequency x, a second harmonic overtone η+1200 $\log_2$ 2 is substantially equal to the log-scale frequency x, a third harmonic overtone η+1200 $\log_2$ 3 is substantially equal to the log-scale frequency x, . . . and a 16th harmonic overtone η+1200 $\log_2$ 16 is substantially equal to the log-scale frequency x.

Since the log-scale frequency x takes 360 possible values within the definition range for integration, the denominator is obtained by iteratively computing the expression (53) for 16×5×3×360 times (H×Na×M×Nx times). This approach may be used in common when the following expression (58) is obtained for all the fundamental frequencies F (300 frequencies) and the number m of tone models (three tone models):

$$\overline{w_{ML}^{(t)}(F,m)} \tag{58}$$

Thus, it is enough to perform the above computation just once. On the other hand, the number of the fundamental frequencies F related to computation of the numerator in the integrand on the right side of the expression (50) with respect to the certain log-scale frequency x is substantially smaller than 300 in a value range of the number of the fundamental frequencies F, and becomes 16×15. As with computation of the denominator, when the fundamental frequency is substantially equal to the log-scale frequency x, it is enough to compute the numerator for each of the five fundamental frequencies F. Similarly, when each of the second to 16th overtones of the fundamental frequency F+1200 $\log_2$ h is substantially equal to the log-scale frequency x, it is necessary to compute the numerator. Thus, it is necessary to compute the expression (53) for 16×5 times in total. In other words, a result of computation of the numerator with respect to a certain log-scale frequency x influences only 80 fundamental frequencies F, and does not influence remaining 220 fundamental frequencies F. Since computation of the expression (53) is performed for m three) tone models, the computation of the expression (53) will be finally repeated 16×5×3×360 times (H×Na×M×Nx times, or 86400 times in total) for each of the numerator and the denominator. When the numerator is computed earlier than the denominator, the denominator may be obtained by totalizing the numerators obtained by the repeated computations. Thus, it can be understood that even when the numerator and the denominator are both computed, it is enough to repeat computation of the expression (53) 86400 times. The number of times of the computation is 1/60 of the number of times when the computing process is not sped up as described above. Even an ordinary personal computer commercially available may perform the computation of this level in a short time.

Further, computation of the expression (53) itself may be sped up. Computation of the expression (57) is focused and it is assumed that computation of the expression (57) is performed only when the difference of x−(F+1200 $\log_2$ h) is within the certain range (herein, computation is performed for 5 times within a range of ±2 times the discretization width, namely, when the discretization width is −40 cents, −20 cents, 0 cent, 20 cents, and 40 cents. Then, it can be understood that y in the following expression always takes only five possible values of −2+α, −1+α, 0+α, 1+α, and 2+α when discretization and computations are performed, where α is a decimal of 0.5 or less and is determined according to how the discretized (F+1200 $\log_2$ h) is represented:

$$\exp\left(-\frac{y^2}{2W^2}\right) \tag{59}$$

Accordingly, when the expression (59) is computed with respect to the above five possible values in advance and stored, equivalent computation may be performed only by reading the result of computation of the expression (59) and executing multiplication at the time the estimation is actually performed. A considerably high-speed operation may thereby be attained. 1200 $\log_2$ h may also be computed in advance and stored. This high-speed computation may be generalized so that when the discretization width of each of the log-scale frequency x and the fundamental frequency F is indicated by d, a positive integer b (which is two in the foregoing description) that is smaller than or close to (3W/d) is computed, and Na is defined as (2b+1) times. x−(F+1200 $\log_2$ h) takes (2b+1) values of −b+α, −b+1+α, 0+α, . . . , b−1+α, and b+α. A value of three in the numerator of (3W/d) may be an arbitrary positive integer other than three, and the smaller the value is, the fewer times of computation will be.

Next, in computation of the expression (51), the denominators in the integral expressions on the right side of the expressions (51) and (50) are common. The numerator in the integrand on the right side of the expression (51) may be obtained by computing the expression (55) described before as the function of the log-scale frequency x, with respect to the fundamental frequency F, m, and h in the target range. As described before, the expression (55) is obtained by removing the expression (56) from the expression (52). Using the approach to the high-speed operation described above, computation of the expression (51) may be likewise sped up.

A flow of the computation described above will be summarized as follows:

1. 1200 $\log_2$ h and $\exp[-(x-(F+1200 \log_2 h))^2/2W^2]$ are computed in advance and stored in the memory.

2. The computations described below is repeated until convergence is obtained, or for a predetermined number of times.

3. The computation described below is performed on each frequency x of the probability density functions of frequency components of input audio signals (represented by the expression (1)) for Nx times (when the frequency axis in the definition range is discretized into 360 frequency values, for example, the computation is performed 360 times).

4. Using the result of computation in advance, with respect to the fundamental frequency F wherein $x-(F+1200 \log_2 h)$ is substantially zero, the numerator of the integrand on the right side of the expression (51) is computed M times for all m (from 1 to M), wherein the numerator is represented by the following expression (60)

$$w'^{(t)}(F, m)c'^{(t)}(h \mid F, m)\frac{1}{\sqrt{2\pi W^2}}\exp\left(-\frac{(x-(F+1200 \log_2 h))^2}{2W^2}\right) \tag{60}$$

Then, the numerator represented by the expression (52) in the integrand on the right side of the expression (50) is also computed.

5. Using the results described above, the denominator in the integrand on the right side of each of the expressions (50) and (51) is computed.

6. Thus, a fraction value in the integrand on the right side on each of the expressions (50) and (51) is determined. The fraction value for the expression (50) is added cumulatively to the expression (47) only at fundamental frequencies F related to computation of the current log-scale frequency x. The fraction value for the expression (51) is also added cumulatively to the expression (48) only at fundamental frequencies F related to computation of the current log-scale frequency x. Note that the number of the related fundamental frequencies F is only 16×5 (H×Na) frequencies among all possible 300 frequencies.

Since the above-mentioned addition (updating of the expressions (47) and (48)) is carried out for each x, by sequentially performing the addition while changing the log-scale frequency x for all possible values, integration of the right side in each of the expressions (50) and (51) can be implemented.

By running in the computer the program that executes the algorithm shown in FIGS. 2 and 3, which implements the method of the present invention, means for performing each computation described above is implemented in the computer, and a pitch-estimation system of the present invention is configured. Accordingly, the pitch-estimation system of the present invention is a result obtained by running the program of the present invention in the computer.

By obtaining the weight $\omega^{(t)}(F,m)$ which can be interpreted as the probability density function of the fundamental frequency and the relative amplitude $c^{(t)}(h|F,m)$ of the h-th harmonic component represented by the probability density function $p(x|F,m,\mu^{(t)}(F,m))$ for all the tone models through computations using the computer, the computations may be completed at a speed at least 60 times faster than ever. Accordingly, even if a high-speed computer is not employed, real-time pitch estimation becomes possible.

In the processing after the weight that can be interpreted as the probability density function of the fundamental frequency has been obtained, a multiple agent model may be introduced, as described in Japanese Patent No. 3413634. Then, different agents may track trajectories of peaks of probability density functions that satisfy predetermined criteria, and a trajectory of a fundamental frequency held by an agent with highest reliability and greatest power may be adopted. This process is described in detail in Japanese Patent No. 3413634 and Non-patent Documents 1 and 2. Descriptions about this process are omitted from the specification of the present invention.

The invention claimed is:

1. A pitch-estimation method of estimating a pitch in terms of fundamental frequency, the method comprising the steps of:

observing frequency components included in an input sound mixture and representing the observed frequency components as a probability density function given by an expression (a) where x is a log-scale frequency:

$$p_{\Psi}^{(t)}(x) \tag{a}$$

obtaining a probability density function of a fundamental frequency F represented by an expression (b) from the probability density function of the observed frequency components:

$$p_{F0}^{(t)}(F) \tag{b}$$

in the step of obtaining a probability density function of a fundamental frequency F, use of multiple tone models, tone model parameter estimation, and introduction of a prior distribution for model parameters being adopted, wherein in the use of multiple tone models, assuming that M types of tone models are present for a fundamental frequency, a probability density function of an m-th tone model for the fundamental frequency F is represented by $p(x|F,m,\mu^{(t)}(F,m))$ where $\mu^{(t)}(F,m)$ is a set of model parameters indicating relative amplitude of a harmonic component of the m-th tone model;

in the tone model parameter estimation, it is assumed that the probability density function of the observed frequency components has been generated from a mixture distribution model $p(x|\theta^{(t)})$ defined by an expression (c):

$$p(x \mid \theta^{(t)}) = \int_{F1}^{Fh}\sum_{m=1}^{M} w^{(t)}(F, m)p(x \mid F, m, \mu^{(t)}(F, m))\,dF \tag{c}$$

where $\omega^{(t)}(F,m)$ denotes a weight of the m-th tone model for the fundamental frequency F, $\theta^{(t)}$ is a set of model parameters of $\theta^{(t)}=\{\omega^{(t)},\mu^{(t)}\}$, including the weight $\omega^{(t)}(F,m)$ of the tone model and the relative amplitude $\mu^{(t)}(F,m)$ of the harmonic components of the tone model, $\omega^{(t)}=\{\omega^{(t)}(F,m)|F1\leqq F\leqq Fh,m=1, \ldots, M\}$, $\mu^{(t)}=\{\mu^{(t)}(F,m)|F1\leqq F\leqq Fh,m=1, \ldots, M\}$ in which Fl stands for an allowable lower limit of the fundamental frequency and Fh for an allowable upper limit of the fundamental frequency; and the probability density function of the fundamental frequency F is computed from the weight $\omega^{(t)}(F,m)$ using an expression (d):

$$p_{F0}^{(t)}(F) = \sum_{m=1}^{M} w^{(t)}(F, m) \ (F1 \le F \le Fh) \tag{d}$$

in the introduction of a prior distribution for model parameters, a maximum a posteriori probability estimator of the model parameter $\theta^{(t)}$ is estimated based on a prior distribution for the model parameter $\theta^{(t)}$ by using the Expectation-Maximization algorithm, and expressions (e) and (f) for obtaining two parameter estimates are defined by this estimation, taking account of the prior distributions:

$$\overline{w^{(t)}(F, m)} = \frac{\overline{w_{ML}^{(t)}(F, m)} + \beta_{wi}^{(t)} w_{0i}^{(t)}(F, m)}{1 + \beta_{wi}^{(t)}} \tag{e}$$

$$\overline{c^{(t)}(h \mid F, m)} = \frac{\overline{w_{ML}^{(t)}(F, m)}\ \overline{c_{ML}^{(t)}(h \mid F, m)} + \beta_{\mu i}^{(t)}(F, m) c_{0i}^{(t)}(h \mid F, m)}{\overline{w_{ML}^{(t)}(F, m)} + \beta_{\mu i}^{(t)}(F, m)} \tag{f}$$

the expressions (e) and (f) are used for obtaining the weight $\omega^{(t)}(F,m)$ that can be interpreted as the probability density function of the fundamental frequency F of the expression (b), and a relative amplitude $c^{(t)}(h|F,m)$ (h=1, . . . , H) of an h-th harmonic component as represented by $\mu^{(t)}(F,m)$ of the probability density function $p(x|F,m,\mu^{(t)}(F,m))$ for all the tone models, and H stands for the number of harmonic components including a frequency component of the fundamental frequency;

in the expressions (e) and (f), expressions (g) and (h) respectively represent maximum likelihood estimates in non-informative prior distributions when expressions (i) and (j) are equal to zero:

$$\overline{w_{ML}^{(t)}(F, m)} = \int_{-\infty}^{\infty} p_{\Psi}^{(t)}(x) \frac{w'^{(t)}(F, m) p(x \mid F, m, \mu'^{(t)}(F, m))}{\int_{F1}^{Fh} \sum_{v=1}^{M} w'^{(t)}(\eta, v) p(x \mid \eta, v, \mu'^{(t)}(\eta, v)) d\eta} dx \tag{g}$$

$$\overline{c_{ML}^{(t)}(h \mid F, m)} = \frac{1}{\overline{w_{ML}^{(t)}(F, m)}} \int_{-\infty}^{\infty} p_{\Psi}^{(t)}(x) \frac{w'^{(t)}(F, m) p(x, h \mid F, m, \mu'^{(t)}(F, m))}{\int_{F1}^{Fh} \sum_{v=1}^{M} w'^{(t)}(\eta, v) p(x \mid \eta, v, \mu'^{(t)}(\eta, v)) d\eta} dx \tag{h}$$

$$\beta_{wi}^{(t)} \tag{i}$$

$$\beta_{\mu i}^{(t)}(F, m) \tag{j}$$

in the expressions (e) and (f), an expression (k) is a most probable parameter at which an unimodal prior distribution of the weight $\omega^{(t)}(F,m)$ takes its maximum value, and an expression (l) is a most probable parameter at which an unimodal prior distribution of the model parameter $\mu^{(t)}(F,m)$ takes its maximum value:

$$w_{0i}^{(t)}(F,m) \tag{k}$$

$$c_{0i}^{(t)}(h|F,m) \tag{l}$$

the expression (i) is a parameter that determines how much emphasis is put on the maximum value represented by the expression (k) in the prior distribution, and the expression (j) is a parameter that determines how much emphasis is put on the maximum value represented by the expression (l) in the prior distribution; and in the expressions (g) and (h), $\omega'^{(t)}(F,m)$ and $\mu'^{(t)}(F,m)$ are respectively immediately preceding old parameter estimates when the expressions (e) and (f) are iteratively computed, $\eta$ denotes a fundamental frequency, and $\nu$ indicates what number tone model in the order of the tone models; and obtaining, through computations using a computer, the weight $\omega^{(t)}(F,m)$ that can be interpreted as the probability density function of the fundamental frequency of the expression (b) and the relative amplitude $c^{(t)}(h|F,m)$ of the h-th harmonic component as represented by the model parameter $\mu^{(t)}(F,m)$ of the probability density function $p(x|F,m,\mu^{(t)}(F,m))$ for all the tone models, by iteratively computing the expressions (e) and (f) for obtaining the two parameter estimates, to thereby estimate a pitch in terms of fundamental frequency, wherein in order to compute, using the computer, the parameter estimate represented by the expression (e) and the parameter estimate represented by the expression (f) using the estimates respectively represented by the expressions (g) and (h), the numerator of the expression (g) is expanded as a function of x given by an expression (m):

$$w'^{(t)}(F, m) \sum_{h=1}^{H} c'^{(t)}(h \mid F, m) \frac{1}{\sqrt{2\pi W^2}} \exp\left(-\frac{(x - (F + 1200 \log_2 h))^2}{2W^2}\right) \tag{m}$$

where $\omega'^{(t)}(F,m)$ denotes an old weight, $c'^{(t)}(h|F,m)$ denotes an old relative amplitude of the h-th harmonic component, H stands for the number of the harmonic components including the frequency component of the fundament frequency, m stands for what number tone model in the order of the M types of tone models, and W stands for a standard deviation of a Gaussian distribution for each of the harmonic components; $1200 \log_2 h$ and $\exp[-(x-(F+1200 \log_2 h))^2/2W^2]$ in the expression (m) are computed in advance and then stored in a memory of the computer;

in order to iteratively compute the expressions (e) and (f) for obtaining the two parameter estimates for a predetermined number of times, after the frequency axis of the probability density function of the observed frequency components has been discretized, a first computation in computing the expressions (g) and (h) is performed for Nx times on each of frequencies x where Nx denotes a discretization number in a definition range for the frequency x;

in the first computation, a second computation is performed on each of the M types of tone models in order to obtain a result of the expression (m), the result of the expression (m) is integrated with respect to the fundamental frequency F and the m-th tone model in order to obtain the denominator of each of the expressions (g) and (h), and the probability density function of the observed frequency components is assigned into the expressions (g) and (h), to thereby compute the expressions (g) and (h);

in the second computation, a third computation is performed for H times corresponding to the number of the harmonic components including the frequency component of the fundamental frequency in order to obtain a result of an expression (n), and a result of the expression (m) is obtained by performing the summation of the results of the expression (n), changing the value of h from 1 to H:

$$w'^{(t)}(F, m)c'^{(t)}(h \mid F, m)\frac{1}{\sqrt{2\pi W^2}}\exp\left(-\frac{(x-(F+1200\log_2 h))^2}{2W^2}\right) \quad \text{(n)}$$

in the third computation, a fourth computation is performed for Na times with respect to the fundamental frequency F wherein $x-(F+1200\log_2 h)$ is close to zero, in order to obtain a result of the expression (n), the Na denoting a small positive integer that indicates how many fundamental frequencies F are obtained by discretizing in a range in which $x-(F+1200\log_2 h)$ is sufficiently close to zero;

in the fourth computation, a result of an expression (o) is obtained using $\exp[-(x-(F+1200\log_2 h))^2/2W^2]$ stored in the memory in advance:

$$c'^{(t)}(h \mid F, m)\frac{1}{\sqrt{2\pi W^2}}\exp\left(-\frac{(x-(F+1200\log_2 h))^2}{2W^2}\right) \quad \text{(o)}$$

and the result of the expression (n) is obtained by multiplying the expression (o) by the old weight $\omega'^{(t)}(F,m)$.

2. The pitch-estimation method according to claim 1, wherein when a discretization width for the log-scale frequency x and the fundamental frequency F is defined as a, a positive integer b that is smaller than or close to (3W/d) is calculated, thereby determining the Na as (2b+1), and when the discretization and computations are performed, $x-(F+1200\log_2 h)$ takes (2b+1) possible values including $-b+\alpha$, $-b+1+\alpha, \ldots, 0+\alpha, \ldots, b-1+\alpha, b+\alpha$, where W denotes the standard deviation of the Gaussian distribution representing each of the harmonic components, and $\alpha$ is a decimal equal to or less than 0.5 as determined according to how the discretized $(F+1200\log_2 h)$ is represented.

3. The pitch-estimation method according to claim 1, wherein when a discretization width for the log-scale frequency x and the fundamental frequency F is defined as $\alpha$, a positive integer b that is smaller than or close to (3W/d) is calculated, thereby determining the Na as (2b+1), and when the discretization and computations are performed, $x-(F+1200\log_2 h)$ takes (2b+1) possible values including $-b+\alpha$, $-b+1+\alpha, \ldots, 0+\alpha, \ldots, b-1+\alpha, b+\alpha$, where W denotes the standard deviation of the Gaussian distribution representing each of the harmonic components, and $\alpha$ is a decimal equal to or less than 0.5 as determined according to how the discretized $(F+1200\log_2 h)$ is represented; and values for $\exp[-(x-(F+1200\log_2 h))^2/2W^2]$, in which $x-(F+1200\log_2 h)$ takes the (2b+1) possible values including $-b+\alpha$, $-b+1+\alpha, \ldots, 0+\alpha, \ldots, b-1+\alpha, b+\alpha$, are stored in the memory in advance.

4. The pitch-estimation method according to claim 1, wherein when a discretization width for the log-scale frequency x and the fundamental frequency F is 20 cents and the standard deviation W is 17 cents, the Na is determined as 5, and when the discretization and computation are performed, $x-(F+1200\log_2 h)$ takes values of $-2+\alpha$, $-1+\alpha$, $0+\alpha$, $1+\alpha$, and $2+\alpha$ where $\alpha$ is a decimal equal to or less than 0.5 as determined according to how the discretized $(F+1200\log_2 h)$ is represented.

5. The pitch-estimation method according to claim 1, wherein when a discretization width for the log-scale frequency x and the fundamental frequency F is 20 cents and the standard deviation W is 17 cents, the Na is determined as 5, and when the discretization and computation are performed, $x-(F+1200\log_2 h)$ takes values of $-2+\alpha$, $-1+\alpha$, $0+\alpha$, $1+\alpha$, and $2+\alpha$ where $\alpha$ is a decimal equal to or less than 0.5 as determined according to how the discretized $(F+1200\log_2 h)$ is represented; and values for $\exp[-(x-(F+1200\log_2 h))^2/2W^2]$, in which $x-(F+1200\log_2 h)$ takes values of $-2+\alpha$, $-1+\alpha$, $0+\alpha$, $1+\alpha$, and $2+\alpha$, are stored in the memory in advance.

6. A pitch-estimation system of estimating a pitch in terms of fundamental frequency, comprising a computer and memory device storing a program that when executed by a computer performs the functions to implement the functions of:

observing frequency components included in an input sound mixture and representing the observed frequency components as a probability density function given by an expression (a) where x is a log-scale frequency:

$$p_{\Psi}^{(t)}(x) \quad \text{(a)}$$

obtaining a probability density function of a fundamental frequency F represented by an expression (b) from the probability density function of the observed frequency components:

$$p_{F0}^{(t)}(F) \quad \text{(b)}$$

in the function of the obtaining a probability density function of a fundamental frequency F, use of multiple tone models, tone model parameter estimation, and introduction of a prior distribution for model parameters being adopted, wherein in the use of multiple tone models, assuming that M types of tone models are present for a fundamental frequency, a probability density function of an m-th tone model for the fundamental frequency F is represented by $p(x|F,m,\mu^{(t)}(F,m))$ where $\mu^{(t)}(F,m)$ is a set of model parameters indicating relative amplitude of a harmonic component of the m-th tone model;

in the tone model parameter estimation, it is assumed that the probability density function of the observed frequency components has been generated from a mixture distribution model $p(x|\theta^{(t)}$ defined by an expression (c):

$$p(x \mid \theta^{(t)}) = \int_{F1}^{Fh}\sum_{m=1}^{M} w^{(t)}(F, m)p(x \mid F, m, \mu^{(t)}(F, m))dF \quad \text{(c)}$$

where $\omega^{(t)}(F,m)$ denotes a weight of the m-th tone model for the fundamental frequency F, $\theta^{(t)}$ is a set of model parameters of $\theta^{(t)}=\{\omega^{(t)},\mu^{(t)}\}$ including the weight $\omega^{(t)}(F,m)$ of the tone model and the relative amplitude $\mu^{(t)}(F,m)$ of the harmonic components of the tone model, $\omega^{(t)}=\{\omega^{(t)}(F,m)|F1\leqq F\leqq Fh, m=1, \ldots, M\}$, $\mu^{(t)}=\{\mu^{(t)}(F, m)|Fl\leqq F\leqq Fh, m=1, \ldots, M\}$ in which Fl stands for an allowable lower limit of the fundamental frequency and Fh for an allowable upper limit of the fundamental frequency; and the probability density function of the fundamental frequency F is computed from the weight $\omega^{(t)}(F,m)$ using an expression (d)

$$p_{F0}^{(t)}(F) = \sum_{m=1}^{M} w^{(t)}(F, m) \quad (d)$$

$$(F1 \le F \le Fh)$$

in the introduction of a prior distribution for model parameters, a maximum a posteriori probability estimator of the model parameter $\theta^{(t)}$ is estimated based on a prior distribution for the model parameter $\theta^{(t)}$ by using the Expectation-Maximization algorithm, and expressions (e) and (f) for obtaining two parameter estimates are defined by this estimation, taking account of the prior distributions:

$$\overline{w^{(t)}(F, m)} = \frac{\overline{w_{ML}^{(t)}(F, m)} + \beta_{wi}^{(t)} w_{0i}^{(t)}(F, m)}{1 + \beta_{wi}^{(t)}} \quad (e)$$

$$\overline{c^{(t)}(h \mid F, m)} = \frac{\overline{w_{ML}^{(t)}(F, m)}\ \overline{c_{ML}^{(t)}(h \mid F, m)} + \beta_{\mu i}^{(t)}(F, m) c_{0i}^{(t)}(h \mid F, m)}{\overline{w_{ML}^{(t)}(F, m)} + \beta_{\mu i}^{(t)}(F, m)} \quad (f)$$

the expressions (e) and (f) are used for obtaining the weight $\omega^{(t)}(F,m)$ that can be interpreted as the probability density function of the fundamental frequency F of the expression (b), and a relative amplitude $c^{(t)}(h|F,m)$ (h=1, . . . , H) of an h-th harmonic component as represented by $\mu^{(t)}(F,m)$ of the probability density function $p(x|F,m,\mu^{(t)}(F,m))$ for all the tone models, and H stands for the number of harmonic components including a frequency component of the fundamental frequency;

in the expressions (e) and (f), expressions (g) and (h) respectively represent maximum likelihood estimates in non-informative prior distributions when expressions (i) and (j) are equal to zero:

$$\overline{w_{ML}^{(t)}(F, m)} = \int_{-\infty}^{\infty} p_{\Psi}^{(t)}(x) \frac{w'^{(t)}(F, m)\, p(x \mid F, m, \mu'^{(t)}(F, m))}{\int_{F1}^{Fh} \sum_{\nu=1}^{M} w'^{(t)}(\eta, \nu) p(x \mid \eta, \nu, \mu'^{(t)}(\eta, \nu))\, d\eta}\, dx \quad (g)$$

$$\overline{c_{ML}^{(t)}(h \mid F, m)} = \frac{1}{\overline{w_{ML}^{(t)}(F, m)}} \int_{-\infty}^{\infty} p_{\Psi}^{(t)}(x) \frac{w'^{(t)}(F, m)\, p(x, h \mid F, m, \mu'^{(t)}(F, m))}{\int_{F1}^{Fh} \sum_{\nu=1}^{M} w'^{(t)}(\eta, \nu) p(x \mid \eta, \nu, \mu'^{(t)}(\eta, \nu))\, d\eta}\, dx \quad (h)$$

$$\beta_{wi}^{(t)} \quad (i)$$

$$\beta_{\mu i}^{(t)}(F, m) \quad (j)$$

in the expressions (e) and (f), an expression (k) is a most probable parameter at which an unimodal prior distribution of the weight $\omega^{(t)}(F,m)$ takes its maximum value, and an expression (l) is a most probable parameter at which an unimodal prior distribution of the model parameter $\mu^{(t)}(F,m)$ takes its maximum value:

$$w_{0i}^{(t)}(F,m) \quad (k)$$

$$c_{0i}^{(t)}(h|F,m) \quad (l)$$

the expression (i) is a parameter that determines how much emphasis is put on the maximum value represented by the expression (k) in the prior distribution, and the expression (j) is a parameter that determines how much emphasis is put on the maximum value represented by the expression (l) in the prior distribution; and in the expressions (g) and (h), $\omega'^{(t)}(F,m)$ and $\mu'^{(t)}(F,m)$ are respectively immediately preceding old parameter estimates when the expressions (e) and (f) are iteratively computed, $\eta$ denotes a fundamental frequency, and $\nu$ indicates what number tone model in the order of the tone models, and obtaining, through computations using the computer, the weight $\omega^{(t)}(F,m)$ that can be interpreted as the probability density function of the fundamental frequency of the expression (b) and the relative amplitude $c^{(t)}(h|F,m)$ of the h-th harmonic component as represented by the model parameter $\mu^{(t)}(F,m)$ of the probability density function $p(x|F,m,\mu^{(t)}(F,m))$ for all the tone models, by iteratively computing the expressions (e) and (f) for obtaining the two parameter estimates, to thereby estimate a pitch in terms of fundamental frequency, the pitch-estimation system further comprising:

expanding the numerator of the expression (g) as a function of x given by an expression (m) in order to compute, using the computer, the parameter estimate represented by the expression (e) and the parameter estimate represented by the expression (f) using the estimates respectively represented by the expressions (g) and (h):

$$w'^{(t)}(F, m) \sum_{h=1}^{H} c'^{(t)}(h \mid F, m) \frac{1}{\sqrt{2\pi W^2}} \exp\left(-\frac{(x - (F + 1200 \log_2 h))^2}{2W^2}\right) \quad (m)$$

where $\omega'^{(t)}(F,m)$ denotes an old weight, $c'^{(t)}(h|F,m)$ denotes an old relative amplitude of the h-th harmonic component, H stands for the number of the harmonic components including the frequency component of the fundament frequency, m stands for what number tone model in the order of the M types of tone models, and W stands for a standard deviation of a Gaussian distribution for each of the harmonic components;

computing in advance 1200 $\log_2$ h and performing a first computation in computing the expressions (g) and (h) for performing in the first computation, a second computation on each of the M types of tone models in order to obtain a result of the expression (m), integrating the result of the expression (m) with respect to the fundamental frequency F and the m-th tone model in order to obtain the denominator of each of the expressions (g) and (h), and assigning the probability density function of the observed frequency components into the expressions (g) and (h), to thereby compute the expressions (g) and (h);

performing in the second computation, a third computation for H times performing in the third computation, a fourth computation for Na times with the fourth computation obtaining a result of an expression (o) corresponding to the number of the harmonic components including the frequency component of the fundamental frequency in order to obtain a result of an expression (n), and obtaining a result of the expression (m) by performing the summation of the results of the expression (n), changing the value of h from 1 to H:

$$w'^{(t)}(F,m)c'^{(t)}(h \mid F,m)\frac{1}{\sqrt{2\pi W^2}}\exp\left(-\frac{(x-(F+1200\log_2 h))^2}{2W^2}\right) \quad \text{(n)}$$

and performing in the second computation, a third computation for H times performing in the third computation, a fourth computation for Na times with the fourth computation obtaining a result of an expression (o) respect to the fundamental frequency F wherein $x-(F+1200\log_2 h)$ is close to zero, in order to obtain a result of the expression (n), the Na denoting a small positive integer that indicates how many fundamental frequencies F are obtained by discretizing in a range in which $x-(F+1200\log_2 h)$ is sufficiently close to zero, performing in the second computation, a third computation for H times performing in the third computation, a fourth computation for Na times with the fourth computation obtaining a result of an expression (o) using $\exp[-(x-(F+1200\log_2 h))^2/2W^2]$ stored in the memory in advance:

$$c'^{(t)}(h \mid F,m)\frac{1}{\sqrt{2\pi W^2}}\exp\left(-\frac{(x-(F+1200\log_2 h))^2}{2W^2}\right) \quad \text{(o)}$$

and obtaining the result of the expression (n) by multiplying the expression (o) by the old weight $\omega'^{(t)}(F,m)$.

7. The pitch-estimation system according to claim 6, wherein when a discretization width for the log-scale frequency x and the fundamental frequency F is defined as d, a positive integer b that is smaller than or close to (3W/d) is calculated, thereby determining the Na as (2b+1), and when the discretization and computations are performed, $x-(F+1200\log_2 h)$ takes (2b+1) possible values including $-b+\alpha$, $-b+1+\alpha$, . . . , $0+\alpha$, . . . , $b-1+\alpha$, $b+\alpha$, where W denotes the standard deviation of the Gaussian distribution representing each of the harmonic components, and $\alpha$ is a decimal equal to or less than 0.5 as determined according to how the discretized $(F+1200\log_2 h)$ is represented.

8. The pitch-estimation system according to claim 6, wherein when a discretization width for the log-scale frequency x and the fundamental frequency F is defined as d, a positive integer b that is smaller than or close to (3W/d) is calculated, thereby determining the Na as (2b+1), and when the discretization and computations are performed, $x-(F+1200\log_2 h)$ takes (2b+1) possible values including $-b+\alpha$, $-b+1+\alpha$, . . . , $0+\alpha$, . . . , $b-1+\alpha$, $b+\alpha$, where W denotes the standard deviation of the Gaussian distribution representing each of the harmonic components, and $\alpha$ is a decimal equal to or less than 0.5 as determined according to how the discretized $(F+1200\log_2 h)$ is represented; and values for $\exp[-(x-(F+1200\log_2 h))^2/2W^2]$, in which $x-(F+1200\log_2 h)$ takes the (2b+1) possible values including $-b+\alpha$, $-b+1+\alpha$, . . . , $0+\alpha$, . . . , $b-1+\alpha$, $b+\alpha$, are stored in the memory in advance.

9. The pitch-estimation system according to claim 6, wherein when a discretization width for the log-scale frequency x and the fundamental frequency F is 20 cents and the standard deviation W is 17 cents, the Na is determined as 5, and when the discretization and computation are performed, $x-(F+1200\log_2 h)$ takes values of $-2+\alpha$, $-1+\alpha$, $0+\alpha$, $1+\alpha$, and $2+\alpha$ where $\alpha$ is a decimal equal to or less than 0.5 as determined according to how the discretized $(F+1200\log_2 h)$ is represented.

10. The pitch-estimation system according to claim 6, wherein when a discretization width for the log-scale frequency x and the fundamental frequency F is 20 cents and the standard deviation W is 17 cents, the Na is determined as 5, and when the discretization and computation are performed, $x-(F+1200\log_2 h)$ takes values of $-2+\alpha$, $-1+\alpha$, $0+\alpha$, $1+\alpha$, and $2+\alpha$ where $\alpha$ is a decimal equal to or less than 0.5 as determined according to how the discretized $(F+1200\log_2 h)$ is represented; and values for $\exp[-(x-(F+1200\log_2 h))^2/2W^2]$, in which $x-(F+1200\log_2 h)$ takes values of $-2+\alpha$, $-1+\alpha$, $0+\alpha$, $1+\alpha$, and $2+\alpha$, are stored in the memory in advance.

11. A computer readable memory storing a pitch-estimation program of estimating a pitch in terms of fundamental frequency, when executed by a computer performs the functions of:

observing frequency components included in an input sound mixture and representing the observed frequency components as a probability density function given by an expression (a) where x is a log-scale frequency:

$$p_{\Psi}^{(t)}(x) \quad \text{(a)}$$

obtaining a probability density function of a fundamental frequency F represented by an expression (b) from the probability density function of the observed frequency components:

$$p_{F0}^{(t)}(F) \quad \text{(b)}$$

in the function of the obtaining a probability density function of a fundamental frequency F, use of multiple tone models, tone model parameter estimation, and introduction of a prior distribution for model parameters being adopted, wherein in the use of multiple tone models, assuming that M types of tone models are present for a fundamental frequency, a probability density function of an m-th tone model for the fundamental frequency F is represented by $p(x|F,m,\mu^{(t)}(F,m))$ where $\mu^{(t)}(F,m)$ is a set of model parameters indicating relative amplitude of a harmonic component of the m-th tone model;

in the tone model parameter estimation, it is assumed that the probability density function of the observed frequency components has been generated from a mixture distribution model $p(x|\theta^{(t)}$ defined by an expression (c):

$$p(x \mid \theta^{(t)}) = \int_{F1}^{Fh} \sum_{m=1}^{M} w^{(t)}(F, m) p(x \mid F, m, \mu^{(t)}(F, m)) dF \tag{c}$$

where $\omega^{(t)}(F,m)$ denotes a weight of the m-th tone model for the fundamental frequency F, $\theta^{(t)}$ is a set of model parameters of $\theta^{(t)}=\{\omega^{(t)},\mu^{(t)}\}$ including the weight $\omega^{(t)}(F,m)$ of the tone model and the relative amplitude $\mu^{(t)}(F,m)$ of the harmonic components of the tone model, $\omega^{(t)}=\{\omega^{(t)}(F,m)|F1 \leqq F \leqq Fh, m=1, \ldots, M\}$, $\mu^{(t)}=\{\mu^{(t)}(F,m)|F1 \leqq F \leqq Fh, m=1, \ldots, M\}$ in which Fl stands for an allowable lower limit of the fundamental frequency and Fh for an allowable upper limit of the fundamental frequency, and the probability density function of the fundamental frequency F is computed from the weight $\omega^{(t)}(F,m)$ using an expression (d):

$$p_{F0}^{(t)}(F) = \sum_{m=1}^{M} w^{(t)}(F, m) \tag{d}$$

$$(F1 \leq F \leq Fh)$$

in the introduction of a prior distribution for model parameters, a maximum a posteriori probability estimator of the model parameter $\theta^{(t)}$ is estimated based on a prior distribution for the model parameter $\theta^{(t)}$ by using the Expectation-Maximization algorithm, and expressions (e) and (f) for obtaining two parameter estimates are defined by this estimation, taking account of the prior distributions:

$$\overline{w^{(t)}(F, m)} = \frac{\overline{w_{ML}^{(t)}(F, m)} + \beta_{wi}^{(t)} w_{0i}^{(t)}(F, m)}{1 + \beta_{wi}^{(t)}} \tag{e}$$

$$\overline{c^{(t)}(h \mid F, m)} = \frac{\overline{w_{ML}^{(t)}(F, m)}\ \overline{c_{ML}^{(t)}(h \mid F, m)} + \beta_{\mu i}^{(t)}(F, m) c_{0i}^{(t)}(h \mid F, m)}{\overline{w_{ML}^{(t)}(F, m)} + \beta_{\mu i}^{(t)}(F, m)} \tag{f}$$

the expressions (e) and (f) are used for obtaining the weight $\omega^{(t)}(F,m)$ that can be interpreted as the probability density function of the fundamental frequency F of the expression (b), and a relative amplitude $c^{(t)}(h|F,m)$ (h=1, . . . , H) of an h-th harmonic component as represented by $\mu^{(t)}(F,m)$ of the probability density function $p(x|F,m,\mu^{(t)}(F,m))$ for all the tone models, and H stands for the number of harmonic components including a frequency component of the fundamental frequency;

in the expressions (e) and (f), expressions (g) and (h) respectively represent maximum likelihood estimates in non-informative prior distributions when expressions (i) and (j) are equal to zero:

$$\overline{w_{ML}^{(t)}(F, m)} = \int_{-\infty}^{\infty} p_{\psi}^{(t)}(x) \frac{w'^{(t)}(F, m)\, p(x \mid F, m, \mu'^{(t)}(F, m))}{\int_{F1}^{Fh} \sum_{\nu=1}^{M} w'^{(t)}(\eta, \nu) p(x \mid \eta, \nu, \mu'^{(t)}(\eta, \nu)) d\eta} dx \tag{g}$$

$$\overline{c_{ML}^{(t)}(h \mid F, m)} = \frac{1}{\overline{w_{ML}^{(t)}(F, m)}} \int_{-\infty}^{\infty} p_{\psi}^{(t)}(x) \frac{w'^{(t)}(F, m)\, p(x, h \mid F, m, \mu'^{(t)}(F, m))}{\int_{F1}^{Fh} \sum_{\nu=1}^{M} w'^{(t)}(\eta, \nu) p(x \mid \eta, \nu, \mu'^{(t)}(\eta, \nu)) d\eta} dx \tag{h}$$

$$\beta_{wi}^{(t)} \tag{i}$$

$$\beta_{\mu i}^{(t)}(F, m) \tag{j}$$

in the expressions (e) and (f), an expression (k) is a most probable parameter at which an unimodal prior distribution of the weight $\omega^{(t)}(F,m)$ takes its maximum value, and an expression (l) is a most probable parameter at which an unimodal prior distribution of the model parameter $\mu^{(t)}(F,m)$ takes its maximum value:

$$w_{0i}^{(t)}(F,m) \tag{k}$$

$$c_{0i}^{(t)}(h|F,m) \tag{l}$$

the expression (i) is a parameter that determines how much emphasis is put on the maximum value represented by the expression (k) in the prior distribution, and the expression (j) is a parameter that determines how much emphasis is put on the maximum value represented by the expression (l) in the prior distribution; and in the expressions (g) and (h), $\omega'^{(t)}(F,m)$ and $\mu'^{(t)}(F,m)$ are respectively immediately preceding old parameter estimates when the expressions (e) and (f) are iteratively computed, $\eta$ denotes a fundamental frequency, and $\nu$ indicates what number tone model in the order of the tone models, and obtaining, through computations using the computer, the weight $\omega^{(t)}(F,m)$ that can be interpreted as the probability density function of the fundamental frequency of the expression (b) and the relative amplitude $c^{(t)}(h|F,m)$ of the h-th harmonic component as represented by the model parameter $\mu^{(t)}(F,m)$ of the probability density function $p(x|F,m,\mu^{(t)}(F,m))$ for all the tone models, by iteratively computing the expressions (e) and (f) for obtaining the two parameter estimates, to thereby estimate a pitch in terms of fundamental frequency, the pitch-estimation program further implementing the functions of:

expanding the numerator of the expression (g) as a function of x given by an expression (m) in order to compute, using the computer, the parameter estimate represented by the expression (e) and the parameter estimate represented by the expression (f) using the estimates respectively represented by the expressions (g) and (h):

$$w'^{(t)}(F, m) \sum_{h=1}^{H} c'^{(t)}(h \mid F, m) \frac{1}{\sqrt{2\pi W^2}} \exp\left(-\frac{(x - (F + 1200 \log_2 h))^2}{2W^2}\right) \tag{m}$$

where $\omega'^{(t)}(F,m)$ denotes an old weight, $c'^{(t)}(h|F,m)$ denotes an old relative amplitude of the h-th harmonic component, H stands for the number of the harmonic components including the frequency component of the fundament frequency, m stands for what number tone model in the order of the M types of tone models, and W stands for a standard deviation of a Gaussian distribution for each of the harmonic components;

computing in advance 1200 $\log_2$ h and $\exp[-(x-(F+1200 \log_2 h))^2/2W^2]$ in the expression (m) and storing the results in a memory of the computer;

performing a first computation in computing the expressions (g) and (h) for Nx times on each of the frequencies x where Nx denotes a discretization number in a definition range for the frequency x, the first computation being performed after the frequency axis of the probability density function of the observed frequency components has been discretized, in order to iteratively compute the expressions (e) and (f) for obtaining the two parameter estimates for a predetermined number of times;

performing, in the first computation, a second computation on each of the M types of tone models in order to obtain a result of the expression (m), integrating the result of the expression (m) with respect to the fundamental frequency F and the m-th tone model in order to obtain the denominator of each of the expressions (g) and (h), and assigning the probability density function of the observed frequency components into the expressions (g) and (h), to thereby compute the expressions (g) and (h);

performing, in the second computation, a third computation for H times corresponding to the number of the harmonic components including the frequency component of the fundamental frequency in order to obtain a result of an expression (n), and obtaining a result of the expression (m) by performing the summation of the results of the expression (n), changing the value of h from 1 to H:

$$w'^{(t)}(F,m)c'^{(t)}(h \mid F,m)\frac{1}{\sqrt{2\pi W^2}}\exp\left(-\frac{(x-(F+1200\log_2 h))^2}{2W^2}\right) \quad \text{(n)}$$

and performing, in the third computation, a fourth computation for Na times with respect to the fundamental frequency F wherein $x-(F+1200 \log_2 h)$ is close to zero, in order to obtain a result of the expression (n), the Na denoting a small positive integer that indicates how many fundamental frequencies F are obtained by discretizing in a range in which $x-(F+1200 \log_2 h)$ is sufficiently close to zero, the fourth computation obtaining a result of an expression (a) using $\exp[-(x-(F+1200 \log_2 h))^2/2W^2]$ stored in the memory in advance:

$$c'^{(t)}(h \mid F,m)\frac{1}{\sqrt{2\pi W^2}}\exp\left(-\frac{(x-(F+1200\log_2 h))^2}{2W^2}\right) \quad \text{(o)}$$

and obtaining the result of the expression (n) by multiplying the expression (o) by the old weight $\omega'^{(t)}(F,m)$.

12. The pitch-estimation program according to claim 11, wherein when a discretization width for the log-scale frequency x and the fundamental frequency F is defined as d, a positive integer b that is smaller than or close to (3W/d) is calculated, thereby determining the Na as (2b+1), and when the discretization and computations are performed, $x-(F+1200 \log_2 h)$ takes (2b+1) possible values including $-b+\alpha$, $-b+1+\alpha$, . . . , $0+\alpha$, . . . , $b-1+\alpha$, $b+\alpha$, where W denotes the standard deviation of the Gaussian distribution representing each of the harmonic components, and $\alpha$ is a decimal equal to or less than 0.5 as determined according to how the discretized $(F+1200 \log_2 h)$ is represented.

13. The pitch-estimation program according to claim 11, wherein when a discretization width for the log-scale frequency x and the fundamental frequency F is defined as d, a positive integer b that is smaller than or close to (3W/d) is calculated, thereby determining the Na as (2b+1), and when the discretization and computations are performed, $x-(F+1200 \log_2 h)$ takes (2b+1) possible values including $-b+\alpha$, $-b+1+\alpha$, . . . , $0+\alpha$, . . . , $b-1+\alpha$, $b+\alpha$, where W denotes the standard deviation of the Gaussian distribution representing each of the harmonic components, and $\alpha$ is a decimal equal to or less than 0.5 as determined according to how the discretized $(F+1200 \log_2 h)$ is represented; and values for $\exp[-(x-(F+1200 \log_2 h))^2/2W^2]$, in which $x-(F+1200 \log_2 h)$ takes the (2b+1) possible values including $-b+\alpha$, $-b+1+\alpha$, . . . , $0+\alpha$, . . . , $b-1+\alpha$, $b+\alpha$, are stored in the memory in advance.

14. The pitch-estimation program according to claim 11, wherein when a discretization width for the log-scale frequency x and the fundamental frequency F is 20 cents and the standard deviation W is 17 cents, the Na is determined as 5, and when the discretization and computation are performed, $x-(F+1200 \log_2 h)$ takes values of $-2+\alpha$, $-1+\alpha$, $0+\alpha$, $1+\alpha$, and $2+\alpha$ where $\alpha$ is a decimal equal to or less than 0.5 as determined according to how the discretized $(F+1200 \log_2 h)$ is represented.

15. The pitch-estimation program according to claim 11, wherein when a discretization width for the log-scale frequency x and the fundamental frequency F is 20 cents and the standard deviation W is 17 cents, the Na is determined as 5, and when the discretization and computation are performed, $x-(F+1200 \log_2 h)$ takes values of $-2+\alpha$, $-1+\alpha$, $0+\alpha$, $1+\alpha$, and $2+\alpha$ where $\alpha$ is a decimal equal to or less than 0.5 as determined according to how the discretized $(F+1200 \log_2 h)$ is represented; and values for $\exp[-(x-(F+1200 \log_2 h))^2/2W^2]$, in which $x-(F+1200 \log_2 h)$ takes values of $-2+\alpha$, $-1+\alpha$, $0+\alpha$, $1+\alpha$, and $2+\alpha$, are stored in the memory in advance.

* * * * *